US005419110A

United States Patent [19]

Mikami et al.

[11] Patent Number: 5,419,110

[45] Date of Patent: May 30, 1995

[54] PIECING METHOD AND APPARATUS IN A SPINNING MACHINE

[75] Inventors: Kazuhiko Mikami; Susumu Banba, both of Kyoto, Japan

[73] Assignee: Murata Kikai Kabushiki Kaisha, Kyoto, Japan

[21] Appl. No.: 30,565

[22] Filed: Mar. 12, 1993

[30] Foreign Application Priority Data

Mar. 16, 1992 [JP] Japan ..... 4-090242

[51] Int. Cl.[6] ..... D01H 15/00

[52] U.S. Cl. ..... 57/261; 57/328

[58] Field of Search ..... 57/5, 261, 263, 328, 57/280

[56] References Cited

U.S. PATENT DOCUMENTS

| | | | |
|---|---|---|---|
| 4,628,684 | 12/1986 | Morita et al. | 57/263 |
| 4,653,260 | 3/1987 | Artzt et al. | 57/263 |
| 4,827,710 | 5/1989 | Nishimura | 57/328 |
| 4,958,487 | 9/1990 | Suganuma et al. | 57/328 |
| 5,083,420 | 1/1992 | Rupert et al. | 57/263 |
| 5,088,265 | 2/1992 | Suganuma et al. | 57/328 |
| 5,146,740 | 9/1992 | Mori | 57/328 |
| 5,159,806 | 11/1992 | Mori et al. | 57/328 |
| 5,193,332 | 3/1993 | Kriegler et al. | 57/263 |

FOREIGN PATENT DOCUMENTS

| | | | |
|---|---|---|---|
| 66528 | 4/1984 | Japan | 57/263 |

*Primary Examiner*—Joseph J. Hail, III

*Attorney, Agent, or Firm*—Spensley Horn Jubas & Lubitz

[57] ABSTRACT

A method, in a spinning machine comprising a spindle portion and a nozzle portion having a first nozzle for exerting a turning air current on a fiber bundle moved out of a drafting device, comprises introducing a yarn end on the package side from the spindle portion into a second nozzle to place it in an open state, turning the yarn end around the spindle by jetting a low pressure air from the first nozzle, and supplying the drafted fiber from the nozzle portion to effect a piecing. A piecing apparatus in the spinning machine comprises device for sucking a spinning yarn wound into a package, device for reversing the package, device for guiding and cutting the sucked spinning yarn, device for transferring a spinning yarn to an outlet side of a spinning yarn of a spindle member separated from a nozzle member of a spinning section, and movable device for threading and opening on a sliver inlet side of the spindle member of the spinning yarn.

13 Claims, 21 Drawing Sheets

PIECING METHOD AND APPARATUS IN A SPINNING MACHINE

BACKGROUND OF THE INVENTION

1. Field of the Invention

This invention relates to a piecing method and an apparatus in a spinning machine in which a turning air current is exerted on an untwisted short fiber bundle drafted by a drafting device to twist it thereby producing a spun yarn.

2. Related Art Statement

The present applicant has proposed and separately applied for an apparatus comprising a spindle and a guide member which projects with an end directed toward an inlet thereof, in which a turning air current is exerted on an untwisted short fiber bundle drafted by a drafting device to twist it thereby producing a spun yarn.

The piecing methods in such a pneumatic type spinning apparatus include three methods, i.e., a knotting by a knotter, a splicing by a splicer, and a piecing for introducing a standard yarn and drawing it out. The spinning speed in the aforementioned spinning apparatus is as high as 300 m/min, and it is difficult for the piecing methods other than a piecing to absorb a sagging of a continuous spinning yarn. Moreover, even the piecing, an automatically carrying-out method is not yet established.

SUMMARY OF THE INVENTION

An object of this invention is to provide a piecing method that can be applied to an apparatus wherein a turning air current is exerted on an untwisted short fiber bundle to twist it thereby producing a spinning yarn at a high speed.

For achieving the aforesaid object, this invention provides a piecing method in a spinning apparatus, said spinning apparatus comprising a spindle portion and a nozzle portion having a guide member which projects with an end thereof directed toward an inlet thereof and a nozzle for exerting a turning air current on a fiber bundle moved out of a drafting device, the method comprising introducing a yarn end on the package side from the spindle portion into the nozzle portion to place it in an open state, turning said yarn end around the spindle by jetting a low pressure air from said nozzle, and supplying the drafted fiber from the nozzle portion to effect a piecing.

In the piecing method in a spinning apparatus constructed as described above, a yarn end on the package side with an end opened is introduced from the spindle into the nozzle portion in the spinning apparatus, and a low pressure air is jetted from the nozzle of the nozzle portion in the spinning apparatus and turns around the spindle. When the drafted fiber is supplied thereto from the nozzle portion, the fiber is entangled with the yarn end during the turning to provide a twisting, whereby yarns are pieced.

An another object of the present invention is to provide a practical piecing apparatus in a spinning machine capable of automatically, positively and speedily restoring a state of yarn-breakage of a spinning yarn which becomes disabled for spinning of a spinning yarn in the stage of forming a spinning yarn or the stage previously thereto.

For achieving the aforesaid object, the present invention provides a piecing apparatus comprising means for sucking a spinning yarn wound into a package, means for reversing the package, means for guiding and cutting the sucked spinning yarn, means for transferring a spinning yarn to an outlet side of a spinning yarn of a spindle member separated from a nozzle member of a spinning section, and means for movable threading and opening on an inlet side of a sliver of said spindle member.

BRIEF DESCRIPTION OF THE DRAWINGS

FIG. 31 is a side view showing the order of operation of a nozzle member, a spindle member, an air sucker member, a transfer arm member and so on.

FIG. 32 is likewise a side view showing the order of operation of a nozzle member, a spindle member, an air sucker member, a transfer arm member and so on.

FIG. 33 is likewise a side view showing the order of operation of a nozzle member, a spindle member, an air sucker member, a transfer arm member and so on.

FIG. 34 is likewise a side view showing the order of operation of a nozzle member, a spindle member, an air sucker member, a transfer arm and so on.

FIG. 35 is likewise a side view showing the order of operation of a nozzle member, a spindle member, an air sucker member, a transfer arm and so on.

FIG. 36 is likewise a side view showing the order of operation of a nozzle member, a spindle member, an air sucker member, a transfer arm and so on.

DETAILED DESCRIPTION OF PREFERRED EMBODIMENTS

Figure 1:
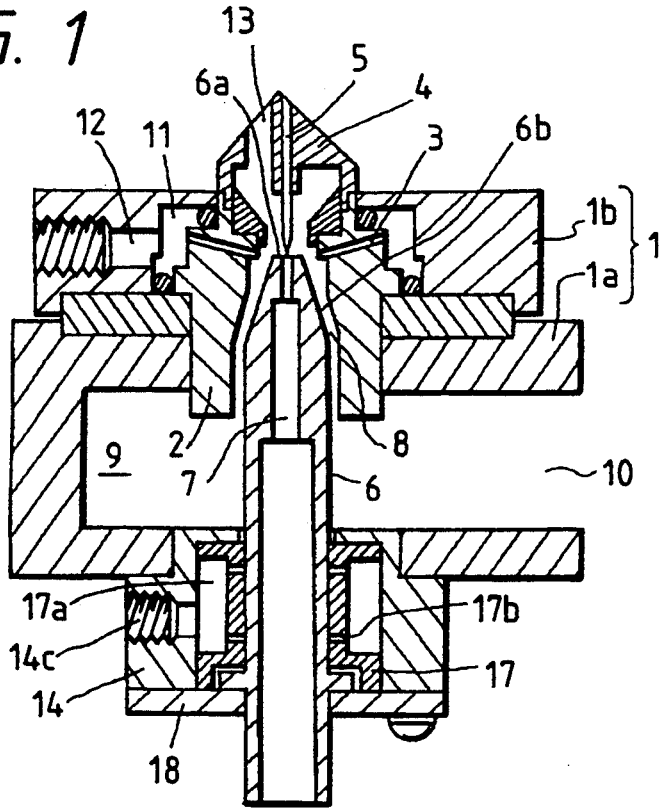
FIG. 1 is a sectional view of a spinning apparatus to which is applied a piecing method according to this invention.

With reference to FIG. 1, one example of a spinning apparatus to which is applied a piecing method according to the present invention will be described below.

This spinning apparatus comprises a nozzle block 2 disposed interiorly of a casing 1 continuous to a drafting device and having a nozzle 3, a guide member supporter 4 located at an inlet thereof and having a guide member 5, and a rotational spindle 6 with its inlet side inserted into the casing 1, the spindle portion capable of being separated from other portions.

A fiber bundle passage 7 extends through the center of the spindle 6. An outside diameter of an inlet 6*a* is sufficiently small. A portion continuous to the inlet 6*a* forms a conical portion 6*b* whose outside diameter increases toward a downstream.

A portion for covering the neighbourhood of the spindle inlet 6*a* of the nozzle block 2 forms a small-diameter cylindrical hollow chamber 8 along the contour thereof, and the forward portion thereof is cylindrical having a slightly larger diameter than a diameter of the end of the spindle 6. A portion continuous to the hollow chamber 8 is formed with an annular hollow chamber 9 formed in a lower casing 1*a* and a tangential air escape hole 10 continuous thereto.

An upper casing 1*b* is interiorly formed with a hollow air reservoir 11 between it and the nozzle block 2. The nozzle block 2 is formed with four air jet nozzles 3 which communicate with the air reservoir 11, are directed downstream slightly away from the inlet 6*a* of the spindle 6 and are directed in a tangential direction with respect to the hollow chamber 8, and a hose not shown is connected to the air reservoir 11 through a hole 12. The direction of the nozzle 3 is set to the same direction of the rotating direction of the spindle 6.

Compressed air supplied from the hose flows into the air reservoir 11, and is jetted into the hollow chamber 8 from the nozzle 3 to generate a high speed turning air current in the vicinity of the spindle inlet 6*a*. This air current turns within the hollow chamber 8 and after this diffuses outwardly while slowly turning within the hollow chamber 9 and is guided toward the escape hole 10 and discharged. At the same time, this air current generates a suction air current which flows from a nipping point of a front roller into a hollow portion of the casing 1.

The guide member supporter 4 has a cap-like shape having a fiber bundle introducing hole 13 at an upper part deviated from the center, and a pin-like guide member 5 is secured to the upper center.

The guide member 5 projects from the upper center of the guide member supporter 4 and rendering its end free and faces to the inlet 6*a* of the spindle 6.

A spindle driving portion is supported by a pneumatic bearing within a bearing casing 14, the driving being effected by a turning air current jetted out of the nozzle 3.

The pneumatic bearing has a cylindrical bush 17 having an air jet hole 17*b* continuous to an air reservoir 17, the bush 17 being fitted into the bearing casing 14, the bearing casing 14 being also provided with a compressed air supplying hole 14*c* in communication with the air reservoir 17*a*.

In the aforesaid pneumatic bearing, when compressed air is supplied from a unshown hose connected to a compressed air supplying hole 14*c*, the compressed air is discharged passing through a small clearance between the spindle 6 and the bush 17 via the air reservoir 17*a* and the air jet hole 17*b*, the spindle 6 being placed in a state not in contact with the bush 17. When the compressed air flows out of the clearance between the spindle 6 and the bush 17, a temperature lowers due to the heat-insulative expansion to cool the periphery.

To spindle driving portion is not provided with a drive device exclusively used for the spindle 6 but has an extremely small rotational resistance due to the employment of the pneumatic bearing. Therefore, if the dimensional precision of the respective members are accurately set, it can provide a high speed rotation, 90,000 rpm by the turning air current jetted out of the nozzle 3.

In the thus constructed spinning apparatus, the fiber bundle moved out of the drafting device is drawn into the apparatus by the action of the air flow jetted out of the nozzle, and the front ends of all the fibers of the fiber bundle are pulled by the fiber bundle being formed into the yarn and guided into the spindle. The rear ends of the fibers are reversed from the spindle inlet and separated into the fibers. The fibers with the rear ends separated are carried away by the turning air current jetted out of the nozzle and are helically wound round the periphery of the fiber bundle being formed into the yarn to provide a real-twist spun yarn. At that time, the spindle driving portion is cooled because the air current is heat-insulated and expanded.

Figure 2:
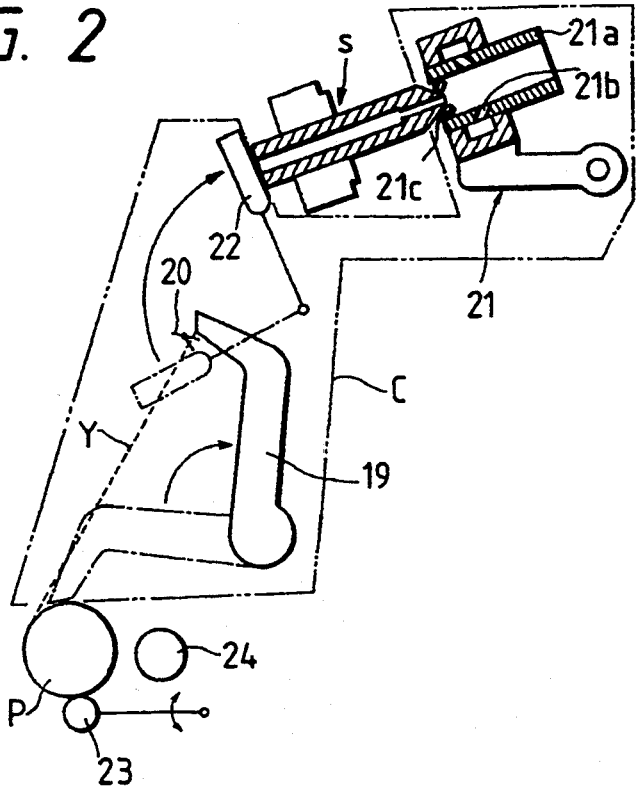
FIG. 2 is a schematic view of one embodiment of a piecing device employed for a piecing in a spinning apparatus according to this invention.

Next, the outline of the piecing apparatus applied to the piecing in the spinning apparatus according to the present invention will be described with reference to FIG. 2.

The piecing in the spinning apparatus of this invention is carried out by a piecing carriage C which runs within the frame or on the front surface of the spinning apparatus. The carriage C is equipped with a suction mouth 19 for sucking and finding a yarn end on the package side on which a spinning yarn to be produced is wound, an unshown nozzle opener (which can be otherwise provided on the side of the spinning apparatus) in which a portion (hereinafter merely referred to as a spinning apparatus nozzle portion) other than a spindle portion S of the spinning apparatus, an unshown air jetting device (a nozzle of the spinning apparatus can be used) for cleaning the spinning apparatus nozzle portion and the spindle portion S, particularly the guide member 5 in question, an opening device 21 for opening the yarn end on the package P side, a yarn guide 22 for gripping the yarn end on the package side P found by the suction mouth 19 to guide it to the spindle portion S, a yarn cutter 20 for cutting the yarn end on the package P side and an unshown cutter guided by the yarn guide 22 to cut into a suitable length the yarn end on the package P side tensioned by a suction force of the opening device 21, a package reversible roller 23 for reversing the package P, and an unshown motor for travelling the piecing carriage along the frame of the spinning apparatus. The motion of these elements is carried out by a cam mechanism sequence-controlled. In FIG. 2, reference numeral 24 designates a touch roller for winding a package.

The opening device 21 comprises a cylindrical member 21*a* having an air jet nozzle 21*b* directed downstream and tangentially and having a ring 21*c* such as rubber inserted into an inlet, is rotatably supported on the piecing carriage C and is rotated so as to come into contact with the spindle inlet after the spinning apparatus nozzle portion is opened from the spindle portion S. Pressure of air jetted out of the air jet nozzle 21*b* is 1 to 1.5 kg/cm$^2$. This opening device 21 is necessary to secure a yarn strength of a piecing portion.

The yarn guide 22 comprises a pair of rollers which can be moved to and from each other and rotatable, grips the yarn end on the package P side sucked and found by the suction mouth 19 located by the solid line at a position indicated by the phantom line, and thereafter rotates to a portion in the vicinity of the outlet of the spindle portion S indicated by the solid line to rotate the roller to draw a predetermined length of yarn. Preferably, an air jet nozzle is provided before the roller to fly a yarn delivered from the roller into the spindle portion S.

The piecing method of the spinning apparatus according to the present invention is generally such that a yarn on the package side is used as a standard yarn, said yarn is introduced into the spinning apparatus nozzle portion to open it, its yarn end is turned round the spindle inlet 6*a* by the low pressure air jetted out of the nozzle 3 of the spinning apparatus nozzle portion and stoodby thereat, and the drafted fibers are supplied thereto to effect the piecing.

The procedure of the piecing method will be described. First, the suction mouth 19 is rotated to the package P side for suction, and the reversible roller 23 is driven to find an yarn end on package side. This yarn Y is gripped by the yarn guide 22, and cut between the yarn guide 22 and the suction mouth 19 by the cutter 20. Next, the spinning apparatus nozzle portion is opened from the spindle portion S, and the spinning apparatus nozzle portion and the spindle portion S are subjected to cleaning. Thereafter, the opening device 21 is moved close to the spindle portion S, and the yarn guide 22 is moved to the outlet of the spindle portion S to draw frontwardly of the spindle the yarn end on the package P side being gripped by the yarn guide 22. After this, the yarn guide is once opened and the yarn is tensioned by the suction force of the opening device 21, after which the yarn is again gripped. The opening device 21 is released from the spindle portion S and at the same time the yarn is cut into a suitable length, and again the opening device 21 is moved close to the cut yarn to suck it and open the same at the same time. The opened yarn end is pulled back by the yarn guide 22 so that the former moves to the inlet end of the spindle portion S. Thereafter, the spinning apparatus nozzle portion is closed and again set, and the low pressure air is jetted out of the nozzle 3 to slowly rotate the opened yarn end round the spindle 6. At that time, a negative pressure is generated in the fiber bundle passage 7 of the spindle 6 to apply a suitable tension to the yarn. After this, the drafting device is driven and at the same time, a delivery roller is driven to pull out the yarn in the spindle 6. The drafted fibers are then entangled with the yarn end during turning to provide a twist. The yarns are pieced, and spinning is again started.

This embodiment of the invention is constructed as described above, and offers the effects as noted below.

That is, the piecing in the apparatus for producing a spun yarn by exerting a turning air current to an untwisted fiber bundle to twist it can be carried out without requiring a particular adjustment of timing but simply and automatically. Moreover, the strength of pieced-up sections is sufficiently large. In addition, even if the spinning speed is high, a sagging of yarn during the step of piecing can be also absorbed.

The control at the time of starting a winding along with another embodiment for carrying out the aforementioned piecing method will be described hereinbelow with reference to FIGS. 3 to 11.

A piecing method in a spinning apparatus according to this invention, said spinning apparatus comprising a spindle, a guide member which projects with an end thereof directed toward an inlet thereof, and a nozzle for exerting a turning air current on a fiber bundle moved out of a drafting device, comprises drawing a yarn end on the package side in an open state outwardly from a spindle inlet, thereafter exerting a turning air current thereon, supplying a drafted fiber bunder, and starting a winding when a yarn tension increases.

In the piecing method in a spinning apparatus constructed as described above, a yarn end on the package side in an open state is drawn out of a spindle inlet of the spinning apparatus and a turning air current is exerted thereon. When the drafted fiber bundle is supplied, the yarn end on the package side is moved toward the guide member while the yarn end on the package side is rotated, the supplied fiber bundle becomes entangled to provide a twist, the yarns are pieced and become twisted and shrunk, and the yarn tension increases. At that time, winding starts.

One example of a pneumatic spinning apparatus to which is applied a piecing method according to the another embodiment of this invention will be described with reference to FIGS. 3 and 4.

This spinning apparatus generally comprises a nozzle block 102 having a nozzle 103 disposed interiorly of a nozzle holder a continuous to a front roller I of a drafting device comprised of a front roller I, a second roller II having an apron II', a third roller III and a back roller IV, a guide member supporter 104 positioned at an inlet portion thereof and having a guide member 105, and a rotational spindle 106 having an inlet side inserted into the nozzle holder A.

Figure 3:
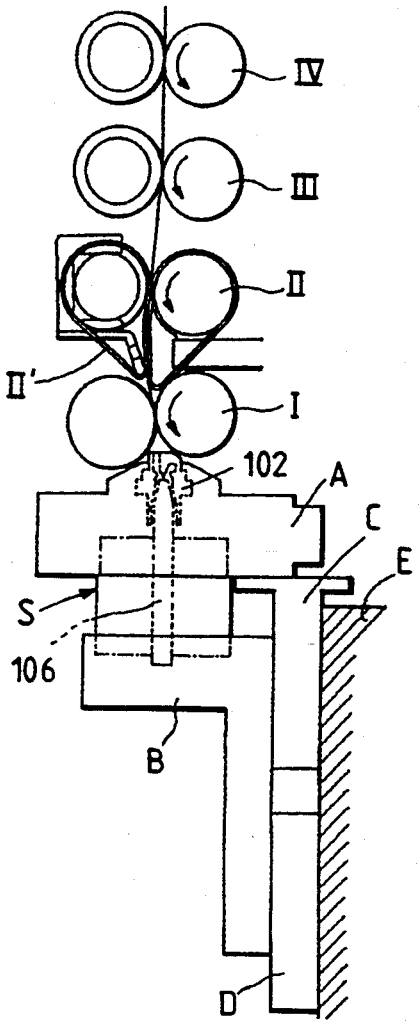
FIG. 3 is a view of arrangement for a drafting device and parts of a spinning apparatus.
Figure 4:
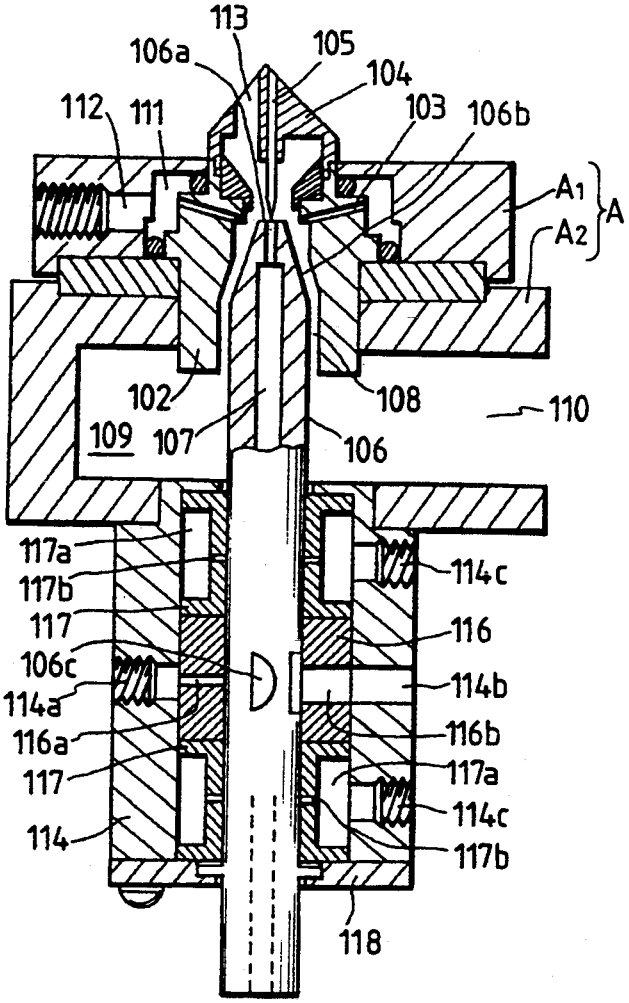
FIG. 4 is a sectional view of essential parts of a spinning apparatus.

The nozzle holder A is secured to a slider C slidably supported on a frame E, and a spindle holder B for holding a spindle portion S as shown by the phantom line in FIG. 3 comprising the spindle portion 106 and a driving portion thereof is secured to a slider D slidably supported on the frame E. Accordingly, the spindle portion S can be separated from the nozzle holder A having a nozzle portion.

A fiber bundle passage 7 extends through the center of the spindle 106. An outside diameter of an inlet 106*a* is sufficiently small. A portion continuous to the inlet 106*a* forms a conical portion 106*b* whose outside diameter increases toward a downstream.

A portion for covering the neighbourhood of the spindle inlet 6*a* of the nozzle block 102 forms a small-diameter cylindrical hollow chamber 108 along the contour thereof, and the forward portion thereof is cylindrical having a slightly larger diameter than a diameter of the end of the spindle 106. A portion continuous to the hollow chamber 108 is formed with an annular hollow chamber 109 formed in a lower nozzle holder $A_2$ and a tangential air escape hole 110 continuous thereto.

An upper nozzle holder A is interiorly formed with a hollow air reservoir 111 between it and the nozzle block 102. The nozzle block 102 is formed with four air jet nozzles 103 which communicate with the air reservoir 111, are directed downstream slightly away from the inlet 106*a* of the spindle 106 and are directed in a tangential direction with respect to the hollow chamber 108, and a hose not shown is connected to the air reservoir 111 through a hole 112. The direction of the nozzle 103 is set to the same direction of the rotating direction of the spindle 106.

Compressed air supplied from the hose flows into the air reservoir 111, and is jetted into the hollow chamber 108 from the nozzle 103 to generate a high speed turning air current in the vicinity of the spindle inlet 106*a*. This air current turns within the hollow chamber 108 and after this diffuses outwardly while slowly turning within the hollow chamber 108 and is guided toward the escape hole 110 and discharged. At the same time, this air current generates a suction air current which flows from a nipping point of a front roller into a hollow portion of the nozzle holder A.

The guide member supporter 104 has a cap-like shape having a fiber bundle introducing hole 113 at an upper part deviated from the center, and a pin-like guide member 105 is secured to the upper center.

The guide member 105 projects from the upper center of the guide member supporter 104 and rendering its end free and faces to the inlet 106*a* of the spindle 106.

A spindle driving portion is supported by a pneumatic bearing within a bearing casing 114 and is driven by an air turbine. Alternatively, the spindle can be driven by a turning air current jetted out of the nozzle 103.

The pneumatic bearing has a cylindrical bush 117 having an air jet hole 117*b* continuous to an air reservoir 117*a*, the bush 117 being fitted into the bearing casing 114, the bearing casing 114 being also provided with a compressed air supplying hole 114*c* in communication with the air reservoir 117*a*. Reference numeral 118 denotes a cap for the bearing casing 114.

In the aforesaid pneumatic bearing, when compressed air is supplied from a unshown hose connected to a compressed air supplying hole 114*c*, the compressed air is discharged passing through a small clearance between the spindle 106 and the bush 117 via the air reservoir 117*a* and the air jet hole 117*b*, the spindle 106 being placed in a state not in contact with the bush 117.

The air turbine is designed so that a cylindrical bush 116 having an compressed air supplying hole 116*a* opened in a tangential direction and an air discharge hole 116*b* is fitted into the bearing casing 114, the bearing casing 114 being also provided with an compressed air supplying hole 114*a* or an air discharge hole 114*b* in communication with the compressed air supplying hole 116*a* or the air discharge hole 116*b*, and an outer peripheral surface of the spindle 106 corresponding to an opening of the compressed air supplying hole 116*a* is formed with a plurality of semicircular recesses 106*c* for receiving a jet air current.

In the air turbine, when compressed air is supplied from an unshown hose connected to the compressed air supplying hole 114*a*, the compressed air passes through the compressed air supplying hole 116*a* and impinges on the recess 106*c* of the spindle 106 to rotate the latter. The air current used to rotate the spindle 106 is discharged passing through the air discharge holes 116*b* and 114*b*.

In the thus constructed spinning apparatus, the fiber bundle moved out of the drafting device is drawn into the apparatus by the action of the air flow jetted out of the nozzle 103, and the front ends of all the fibers of the fiber bundle are pulled by the fiber bundle being formed into the yarn and guided into the spindle 106. The rear ends of the fibers are reversed from the spindle inlet 106*a* and separated into the fibers. The fibers with rear ends separated are carried away by the turning air current jetted out of the nozzle 103 and are helically wound round the periphery of the fiber bundle being formed into the yarn to provide a real-twist spun yarn.

Figure 6:
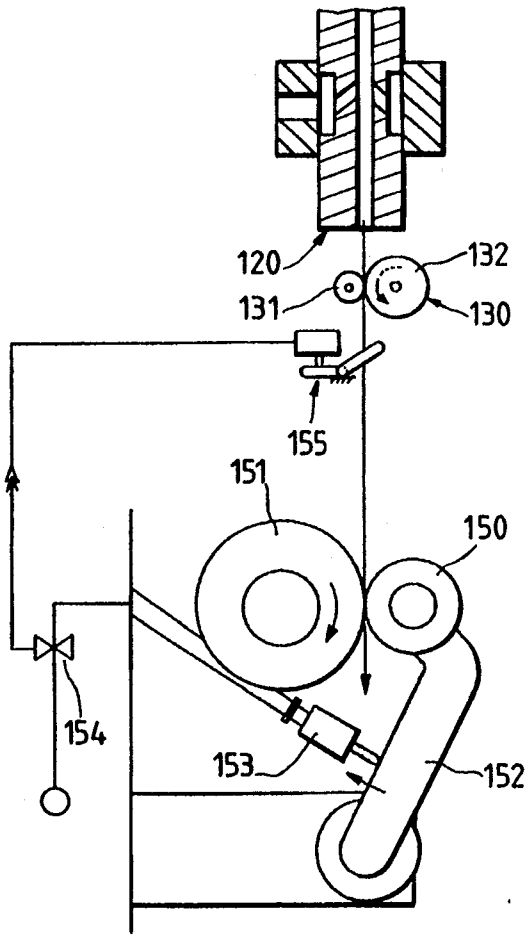
FIG. 6 is a side view showing portions around a delivery roller.
Figure 5:
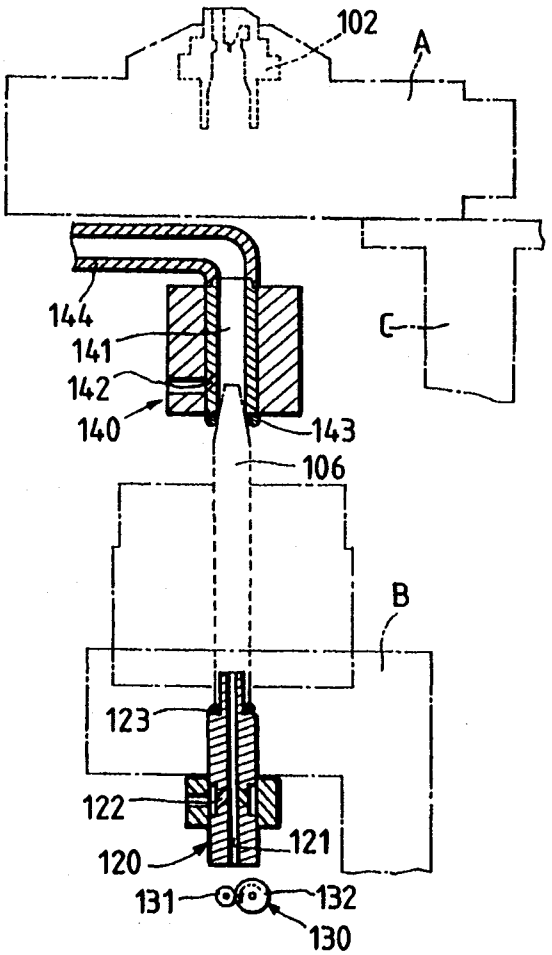
FIG. 5 is a sectional view showing the relationship between an opening sucker, a threading nozzle and an antireversal clamp and parts of a spinning apparatus employed in a piecing method of this invention.
Figure 7:
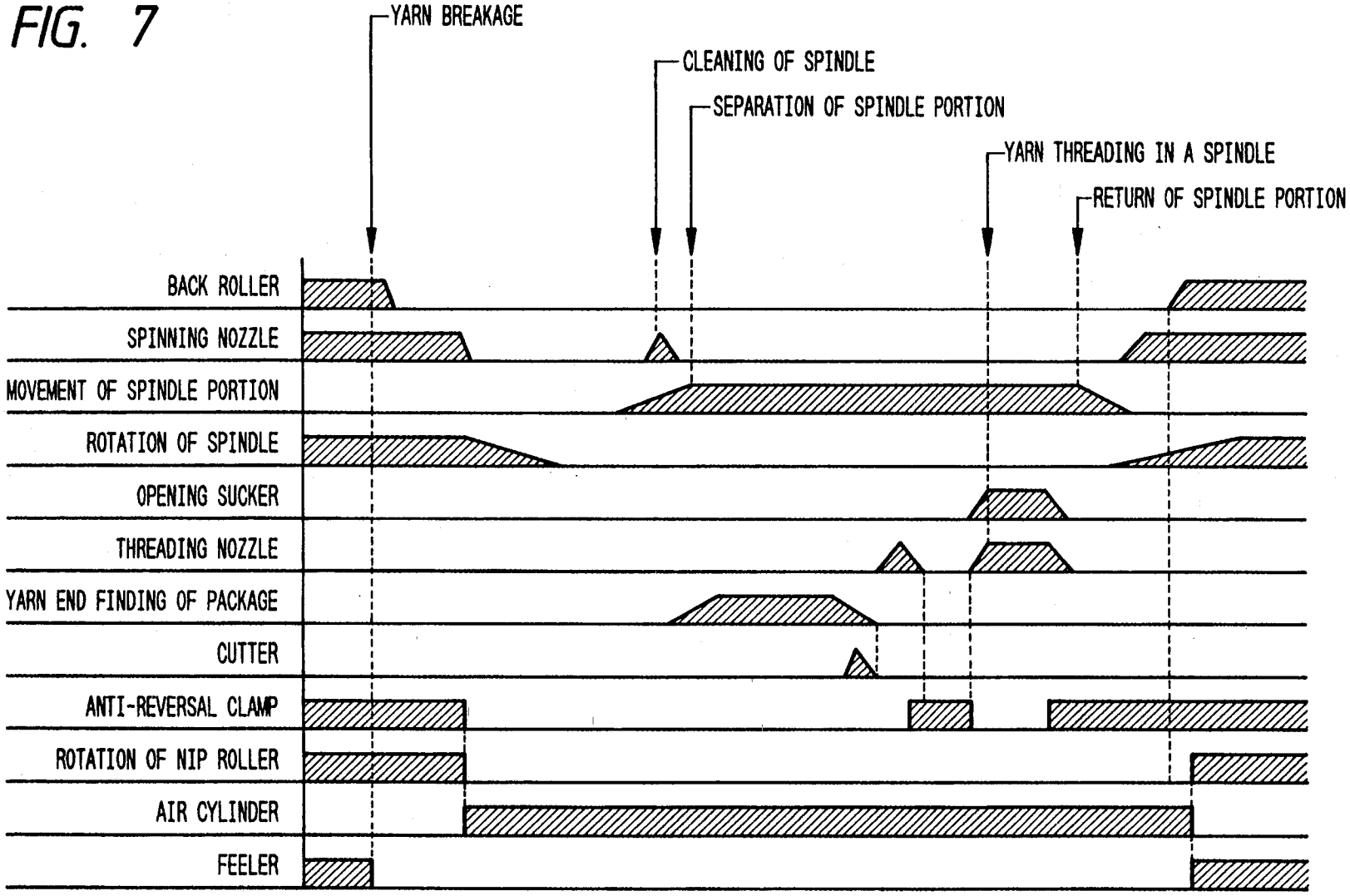
FIG. 7 is a time table showing the operation of a spinning apparatus, an opening sucker, a threading nozzle and so forth when a piecing method of this invention is carried out.
Figure 8:
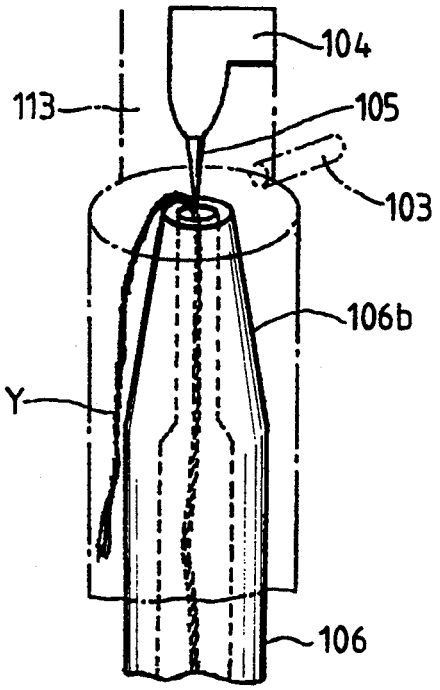
FIG. 8 is a perspective view showing the state in which a yarn end on the package side is sucked into a spindle and hung externally from an inlet.

Next, the outline of the piecing devices provided on every spindle, which are applied to the piecing in the spinning apparatus according to the present invention, will be described with reference to FIGS. 5 and 6.

This piecing device comprises a threading nozzle 120, an anti-reversal clamp 130, an opening sucker 140 and a device for opening and closing a nip roller 150 with respect to a delivery roller 151 during piecing.

The threading nozzle 120 is fixedly mounted at a position where it comes into contact with the rear end of the spindle 106 when the spindle holder B moves back. In a yarn passage 121 formed in the center thereof, a nozzle orifice 122 for jetting compressed air is opened toward an outlet, and the outlet portion is provided with a ring 123 such as rubber serving as a brake which stops the rotation of the spindle 106 when the spindle portion S moves back and comes into contact therewith. In the threading nozzle 120, the yarn end on the package side is found by a suction mouth not shown in the figure and carried, during that period of which it is cut. The yarn end is blown up through the spindle 106 by the air current jetted out of the nozzle hole 122.

The anti-reversal clamp 130 is provided directly behind the threading nozzle 120 and can be rotated only when one roller 131 can be moved to and from the other roller 132 and the yarn on the package side is pulled toward the package. The anti-reversal clamp 130 is to impair the movement of the yarn end on the package side when a force in a releasing direction is applied thereto during piecing.

A yarn passage 141 is formed in the center of the opening sucker 140. A nozzle orifice 142 for jetting compressed air is opened tangentially to the yarn passage 141, and the inlet portion is provided with a ring 143 such as rubber which prevents an entry of air from a clearance when the spindle 106 is inserted. To the outlet portion is connected a hose 144 which leads to a dust box into which is sucked air under low pressure. The opening sucker 140 is normally positioned by the side of the spindle portion, and when the spindle holder B moves back to form a clearance between it and the nozzle holder A, it advances laterally from the clearance and the yarn end on the package side blown up by the threading nozzle 120 is opened by the turning air current jetted out of the nozzle orifice 142. It then returns to its original position after completion of opening. When the yarn end on the package side is opened as described above, the piecing becomes facilitated, and the pieced-up sections remain unchanged from other portions.

The nip roller 150 is supported on a swinging arm 152 urged toward the delivery roller 151 always rotated by a spring not shown. A rod of an air cylinder 153 is in contact with the side of the swinging arm 152, and the rod can be extended to separate the nip roller 150 from the delivery roller 151. The opening and closing of a solenoid valve 154 for supplying and shutting off air to the air cylinder 153 is performed by a signal from a feeler 155 with a microswitch or by a timer not shown. The control made by the feeler 155 utilizes an increase of tension resulting from formation of a yarn with the fiber bundle supplied entangled with the yarn end on the package side during the course of piecing which will be described later, the solenoid valve 154 being closed by a tension-increase signal. In case of using the timer, after a lapse of expected time of preset piecing completion from the time of starting operation of a back-roller IV (normally, when the spinning apparatus stops its operation, the back-roller IV is stopped and the other draft roller remains rotated. But, in case of a 4-line roller, if even a third roller III is also stopped, the time of starting a supply of fiber bundles can be shortened at the time of restart of operation.), the solenoid valve 154 (the nip roller 150 is opened) opened in the piecing is closed. In addition, in case where the control is made by the feeler 155, there is an advantage in that no deviation occurs in the time of start of winding, and a clean and powerful pieced-up sections can be formed.

The piecing operation will be described below mainly referring to FIGS. 7 to 11. A first yarn-hanging work is in accordance therewith.

The piecing method of the spinning apparatus according to the present invention is generally such that a yarn Y on the package side is used as a standard yarn, the yarn end Y on the package side in an open state is drawn out from the spindle inlet of the spinning apparatus, after which a turning air current is exerted thereon and the drafted bundle of fibers F is supplied for piecing.

That is, when the yarn being spun is cut, the air jetting of the spinning nozzle 103 and the rotation of the spindle 106 stop, and the anti-reversal clamp 130 and the nip roller 150 are opened.

Thereafter, the spindle portion S along with the spindle holder B move back, and the opening sucker 140 moves directly behind the nozzle holder A. Air is jetted for a short period of time from the spinning nozzle 103 during the backward movement of the spindle portion S, and fly or waste which remains interiorly and exteriorly of the conical portion **106*b* of the spindle is removed by the stoppage of operation and discharged out of the air escape hole 110. Continuously thereto, the nozzle holder A along with the slider C are moved back by 5 mm or so. When air is jetted for a short period of time from the spinning nozzle 103, the fly remaining on the delivery side of the front roller 101 is blown away by the stoppage of operation. Thereafter, the nozzle holder A returns to its original position and the opening sucker 140** slightly advances.

Shortly after the spindle portion S starts to move back, the yarn end Y on the package side is found by the suction mouth and carried to the threading nozzle 120, during which period the remainder is cut. When compressed air is jetted for a short period of time from the nozzle orifice 122 of the threading nozzle 120, the yarn end Y is moved from the threading nozzle 120 into the spindle 106 and blown up into the opening sucker 140. At the same time, the anti-reversal clamp 130 is closed. The opening of the yarn end Y on the package side is carried out by the opening sucker 140, and the fly remaining in the spindle 106 is removed due to the stoppage of operation. During that period, the anti-reversal clamp 130 is opened, and the threading nozzle 120 is also exerted to draw the yarn. After untwisting, the opening sucker 140 returns to its original position. When this operation is completed, the yarn end assumes a state where it hungs down outwardly from the spindle inlet **106*a*, and the spindle portion also returns to its original position. The length of the yarn end Y drawn out of the spindle inlet 106*a*** is preferably 25 mm, and if it is shorter than that, it is slipped out when the piecing takes place, whereas it is longer than that, the pieced-up sections become beads.

Figure 9:
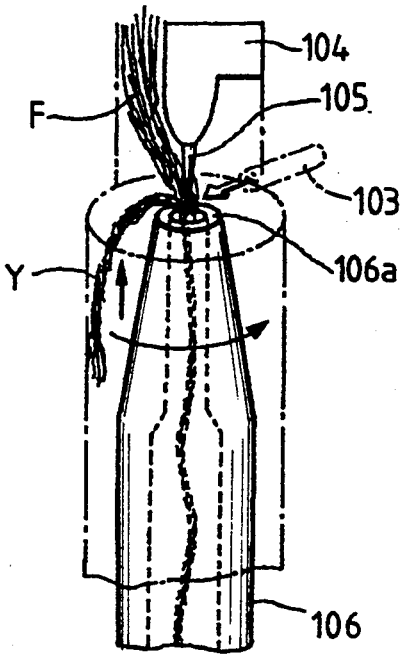
FIG. 9 is a perspective view showing the state where a yarn end on the package side is sucked into a spindle and after this, compressed air starts to jet from a nozzle of a spinning apparatus.
Figure 10:
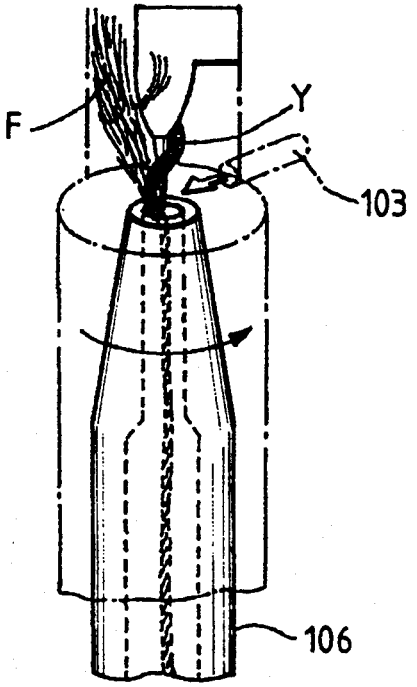
FIG. 10 is a perspective view showing the state where after a yarn end on the package side is sucked into a spindle, jetting of compressed air from a nozzle of a spinning apparatus progresses.

Thereafter, the air jetting of the spinning nozzle 103 and the rotation of the spindle 106 are restarted. When the back-roller IV is rotated, the drawn yarn end Y rotates at a high speed (in the case where the jetting air pressure from the spinning nozzle 103 to 3.0 kg/cm$^2$, 20,000 rpm) (at this time, no twist occurs.). At that time, a flow of the turning current is disturbed, and the yarn end moves up as shown in FIG. 9, and it further moves up as shown in FIG. 10 and becomes entangled with the fiber bundle F supplied, as a consequence of which a shrinkage in twist occurs and it tenses. Immediately after this, the piecing is completed.

Figure 11:
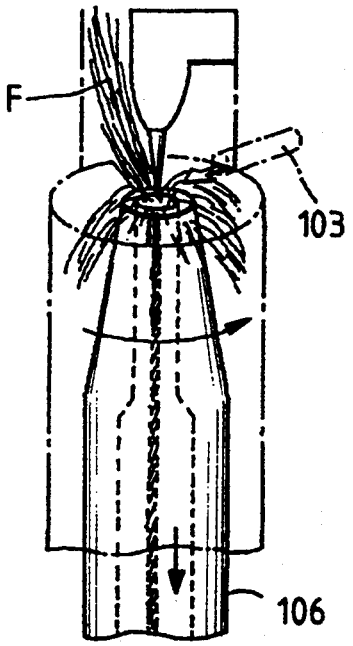
FIG. 11 is a perspective view showing the state where piecing is completed.

In the case where the feeler 155 is provided, the solenoid valve 154 is closed by a yarn tension increase signal, and the nip roller 150 is closed. As shown in FIG. 11, the pieced-up sections advance into the spindle 106, and the operation shifts to a normal operation. In the case where the timer is provided, after the passage of expected time of preset completion of piecing from the time of starting operation of the back-roller IV, the nip roller 150 is closed, after which similar operation takes place.

Being constructed as described above, the present invention offers the effects as noted below.

In an apparatus for exerting a turning air current on an untwist bundle of short fibers to twist it thereby producing a spun yarn, the piecing can be simply and automatically carried out without requiring special adjustment of timing and low-speed operation. In addition, no deviation of time for starting winding occurs, the strength of pieced-up sections becomes unchanged from others and is great, and the external appearance also remains unchanged from other and is beautiful.

Even if the spinning speed is high, it is not necessary to remove sagging of yarn during piecing.

Still another embodiment of the apparatus suitable for carrying out the aforementioned piecing will be described hereinbelow.

The present invention provides a practical piecing apparatus in a spinning machine capable of automatically, positively and speedily restoring a state of yarn-breakage of a spinning yarn which becomes disabled for spinning of a spinning yarn in the stage of forming a spinning yarn or the stage previously thereto.

The present invention provides a piecing apparatus comprising means for sucking a spinning yarn wound into a package, means for reversing the package, means for guiding and cutting the sucked spinning yarn, means for transferring a spinning yarn to an outlet side of a spinning yarn of a spindle member separated from a nozzle member of a spinning section, and means for movable threading and opening on an inlet side of a sliver of said spindle member.

Embodiments of the present invention will be described hereinafter with reference to the drawings.

First, the spinning process of the spinning machine to which the piecing apparatus of the present invention is applied will be mainly described with reference to FIGS. 12 and 13. For convenient sake, the entire spinning section will be described below with reference to FIG. 12 showing the spinning section and the like.

Figure 12:
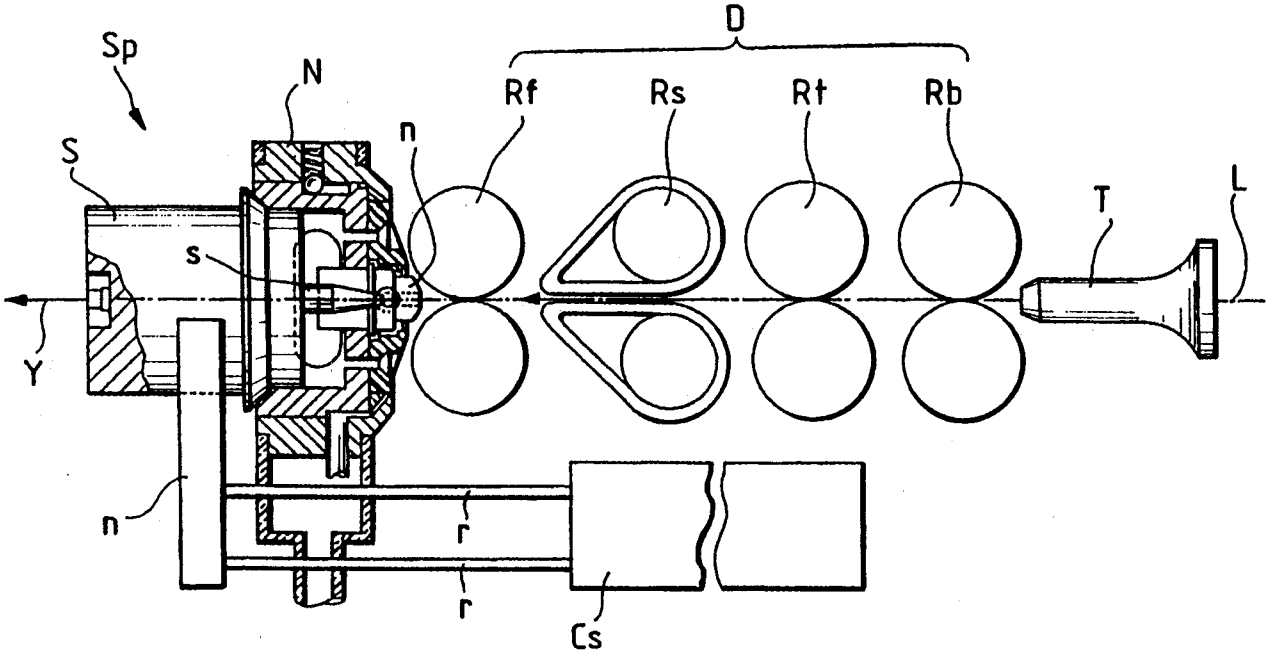
FIG. 12 is a side view including a partial section of a spinning section and a drafting device.

In FIG. 12, reference character L denotes a sliver supplied to a draft device D via a sliver guide T. The draft device D comprises a back-roller Rb, a third roller Rt, a second roller Rs having an apron, and a front roller Rf. The sliver L drafted by the draft device D is supplied to a spinning section Sp comprised of a nozzle member N and a spindle member S, and in the spinning section Sp, a spun yarn Y is formed. The spindle member S is held by a support member h at the end of a rod r of a cylinder Cs, and can be separated from the nozzle member N as will be described later.

Figure 13:
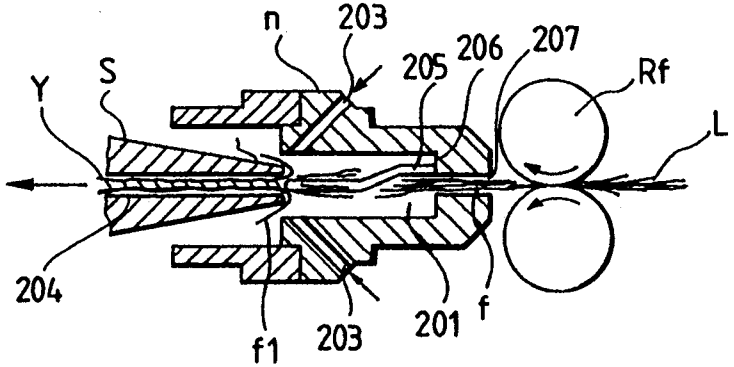
FIG. 13 is a partly enlarged sectional view of a spindle member and a nozzle member.

FIG. 13 is an enlarged partial sectional view of a nozzle n of the nozzle member N and a hollow spindle s of the spindle member S shown in FIG. 12. The nozzle n is formed with a plurality, for example, four air jet holes 203 inclined toward a conical end portion 202 of the hollow spindle s in a tangential direction of a peripheral wall of a cylindrical hollow chamber 201. Within the cylindrical hollow chamber 201, a needle-like guide member 205 smaller in diameter than that of an inlet portion of the hollow passage 204 of the hollow spindle s with a free end thereof arranged opposedly to the inlet portion of the hollow passage 204 is mounted on an inner wall 206 on the side of a front roller Rf of the nozzle n. The hollow spindle s is rotatably supported by suitable driving means such as an air turbine or a driving belt not shown.

The drafted sliver L delivered from the front roller Rf of the draft device D is sucked into the cylindrical hollow chamber 201 within the nozzle n by a suction air current in the vicinity of a sliver introducing hole 207 of the nozzle n being generated by the action of the jet air from the air jet holes 203. Fibers f constituting the sliver L sucked into the cylindrical hollow chamber 201 are sent along the periphery of the needle-like guide member 205, and fibers f1 are jetted out of the air jet holes 203 in the vicinity of the conical end 202 of the hollow spindle s and is subjected to the action of a turning air current being turned at a high speed in the outer periphery of the hollow spindle s and twisted in a direction of the turning air current while being separated from the sliver L.

At that time, since the needle-like guide member 205 impairs to form a core fiber and the hollow spindle s is rotating, the fibers f1 separated from the sliver L are evenly distributed to the outer periphery of the end 202 of the hollow spindle s. Thus the fibers to be a core are hardly present and accordingly, most of fibers are twisted and a wound real-twist spun yarn Y is formed. A false twist applied by the turning air current tends to be propagated in a direction of the front roller Rf but its propagation is impaired by the needle-like guide member 205. Accordingly, the sliver L delivered by the front roller Rf is not twisted by the false twist. As mentioned above, the fibers f1 applied with a false twist are successively formed into the spun yarn Y and fed in a direction of a spun-yarn winding section passing through the hollow passage 204 of the hollow spindle s. The aforementioned apparatus for forming a spinning yarn is disclosed, for example, in Japanese Patent Laid-Open No. HEI 3-161525 publication.

A piecing apparatus will be described below, in which the apparatus runs lengthwise of a spinning machine having a number of spinning units U having the spinning section Sp as described above arranged, and detects the spinning unit U at which yarn breakages occur to effect piecing.

Figure 14:
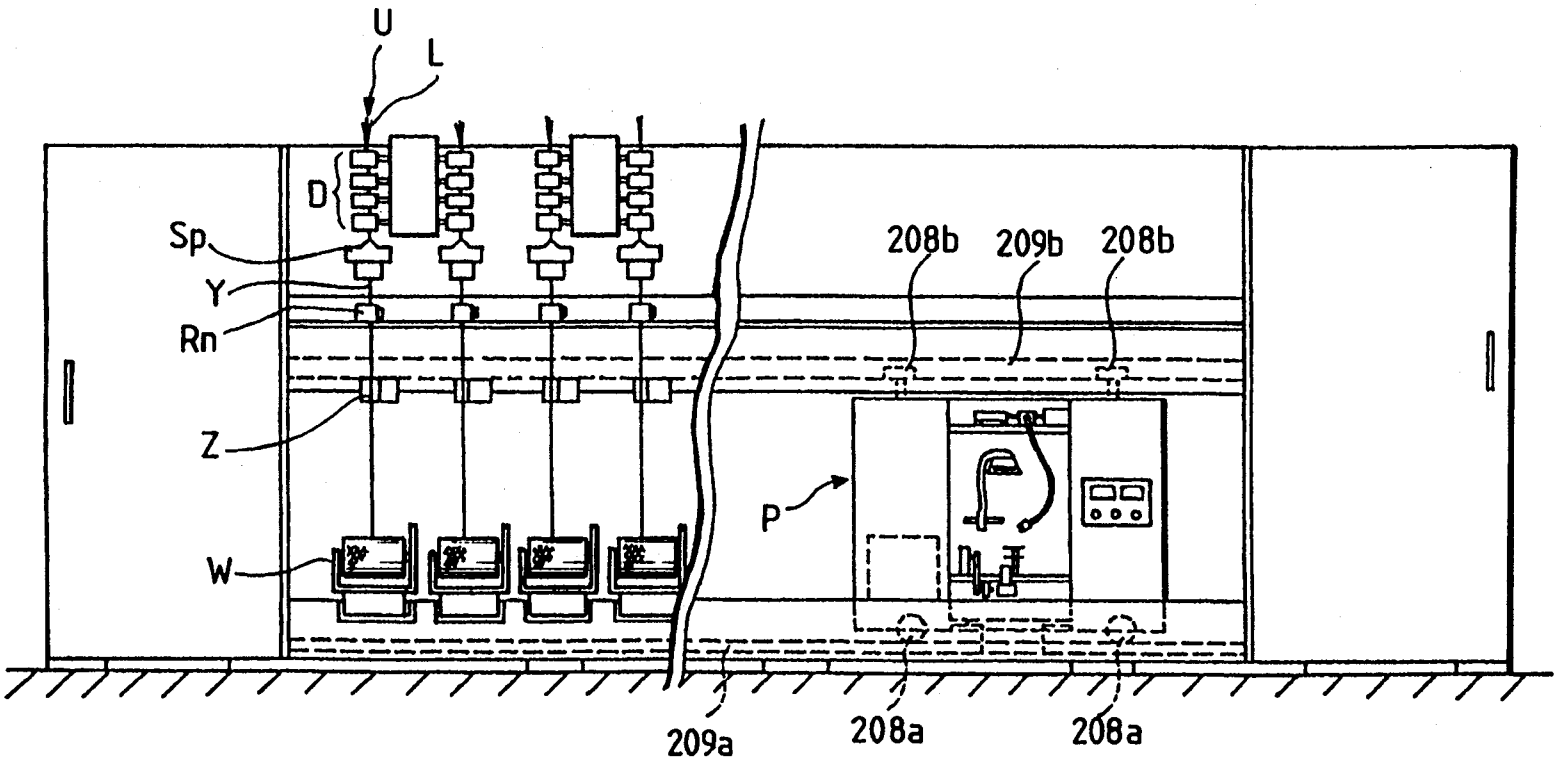
FIG. 14 is a front view showing the entirety of a spinning machine and a piecing device.

FIG. 14 is a front view of the spinning machine with a number of spinning units arranged. The sliver L is fed to the draft device d and formed into a spun-yarn Y by the spinning section Sp, after which the spun yarn Y is wound on a winding portion W via the nip roller Rn and a slub catcher Z. Reference character P denotes a piecing apparatus which will be described later and is designed so that it runs below the spinning machine lengthwise of the spinning machine.

Figure 15:
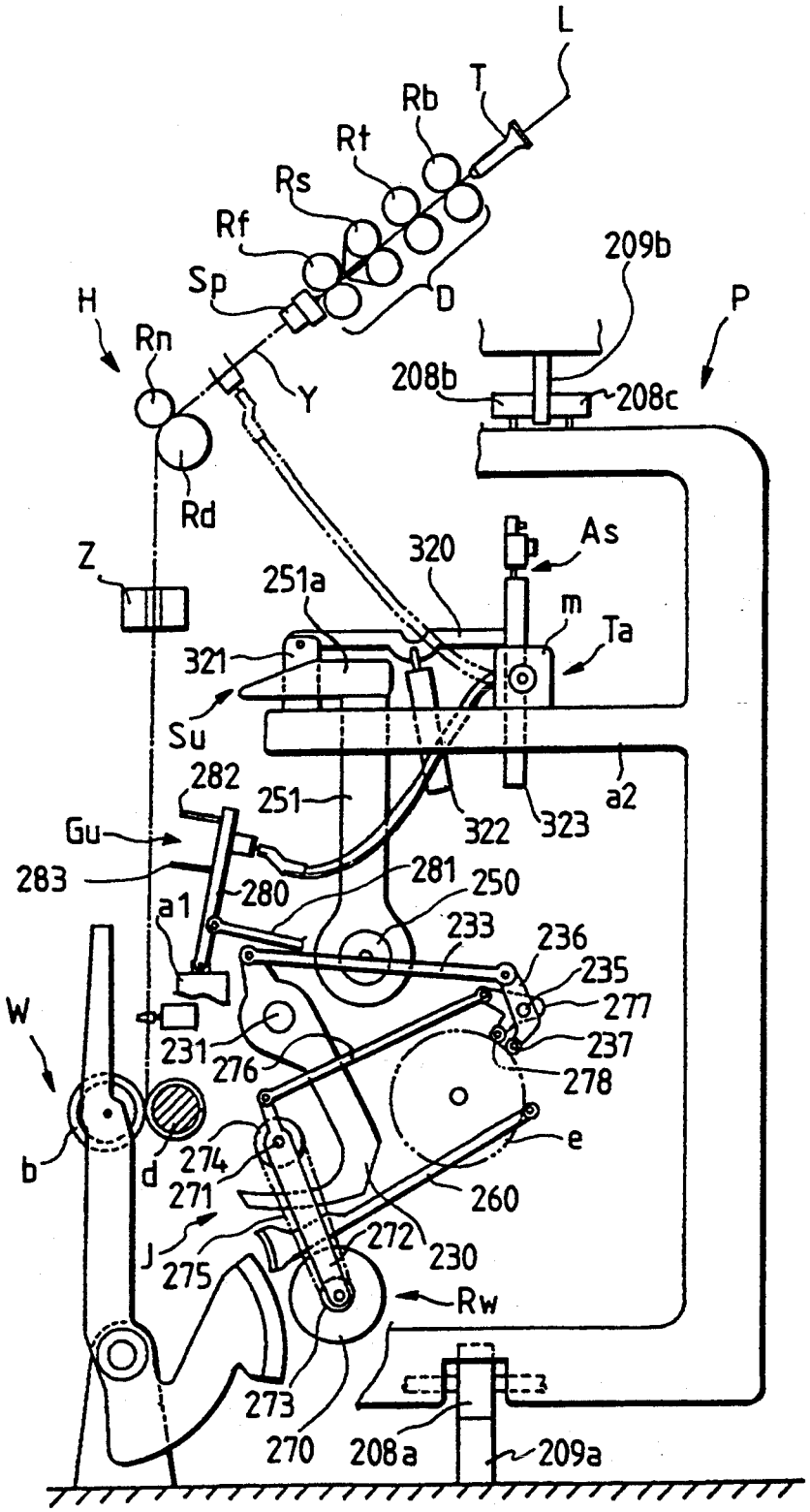
FIG. 15 is a schematic side view of a spinning unit and a piecing device.
Figure 16:
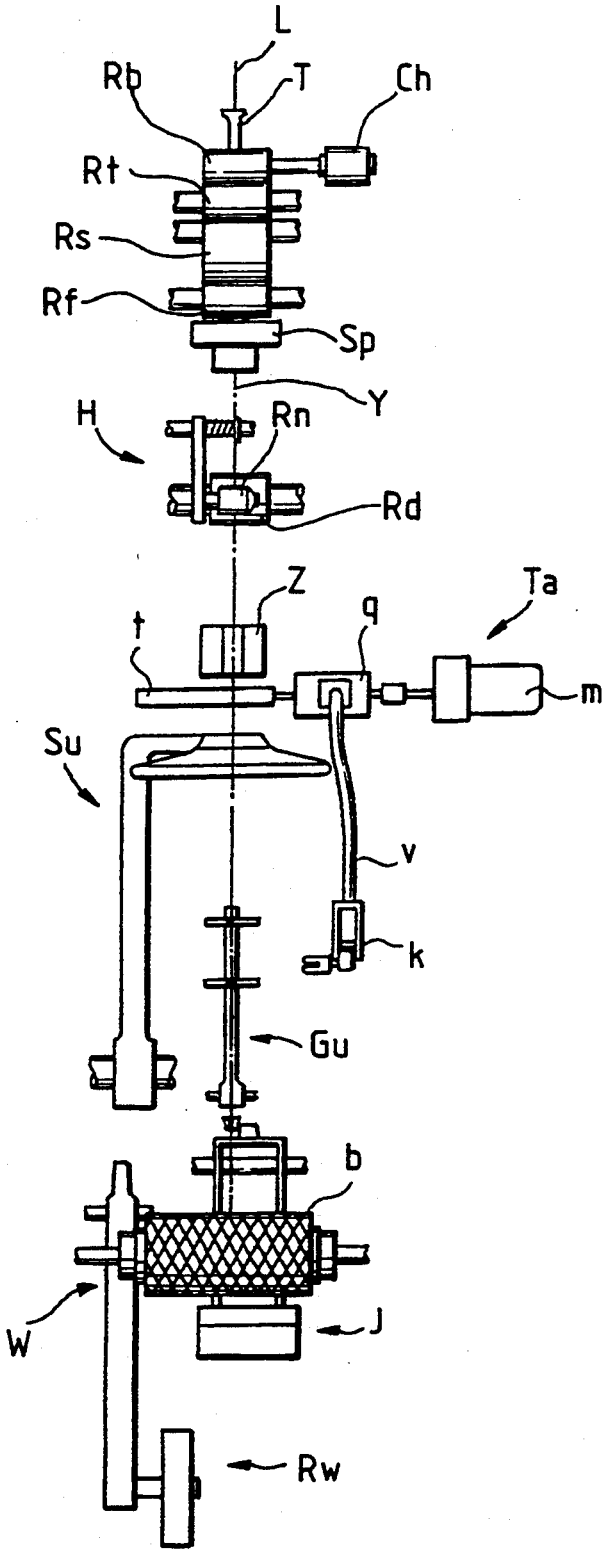
FIG. 16 is a schematic front view of a spinning unit and a piecing device.

With reference to FIG. 15 showing a schematic side view of the spinning unit U and the piecing apparatus P and FIG. 16 showing a schematic front view of the spinning unit U and the piecing apparatus P, the arrangements of the spinning unit U composed of the draft device D, the spinning section Sp, the nip roller Rn, etc. and members constituting the piecing apparatus will be described.

The spinning section Sp is arranged adjacent to the draft device D comprised of the aforementioned back-roller Rb, third roller Rt, second roller Rs having an apron and front roller Rf. The spun yarn Y formed by the spinning section Sp is fed to the spun yarn winding section W via the spun yarn delivery member H comprised of the nip roller Rn and the delivery roller Rd, the slub catcher Z and the like and wound on a package b. In FIG. 16, reference character Ch denotes a solenoid clutch for stopping and driving the back-roller Rb.

On the other hand, the piecing apparatus is composed of a package extruding member J for separating a package b from a friction roller d and holding the package b at that position in order to rewind the spun yarn Y wound into the package b from the package b of the spinning unit U at which yarn breakages occur, a package reversing member Rw for revering the package b separated from the friction roller d in a direction opposite to the winding direction, a suction member Su for drawing a cut end of the spun yarn Y from the package b, a guide member Gu for guiding the spun yarn Y drawn out of the package b to hold it at a predetermined position, a transfer arm member Ta for cutting the spun yarn Y drawn out of the package b to grip it at a predetermined position and transporting it below the spindle member S of the spinning section Sp, an air sucker member As for threading the spun yarn drawn out of the package b to the hollow spindle s of the spindle member S of the spinning section Sp and opening the end of the threaded spun yarn Y, etc.

In FIG. 15, reference numeral 208*a* denotes a wheel which runs on a rail 209*a* arranged on the floor rotatably driven by suitable driving means arranged on the piecing apparatus P, and reference numerals 208*b* and 208*c* denote wheels arranged so as to grip a rail 209*b* arranged on the spinning machine installed above the piecing apparatus P.

In the following, separation means for separating the nozzle member N of the spinning section Sp from the front roller Rf, means for separating the spindle member S from the nozzle member N, cleaning means for the spinning section Sp or the like, a spun-yarn delivery member H, and the package extruding member J, package reversing member Rw, suction member Su, guide member Gu, transfer arm member Ta and air sucker member As, etc which constitute the piecing apparatus P will be described in detail.

Figure 17:
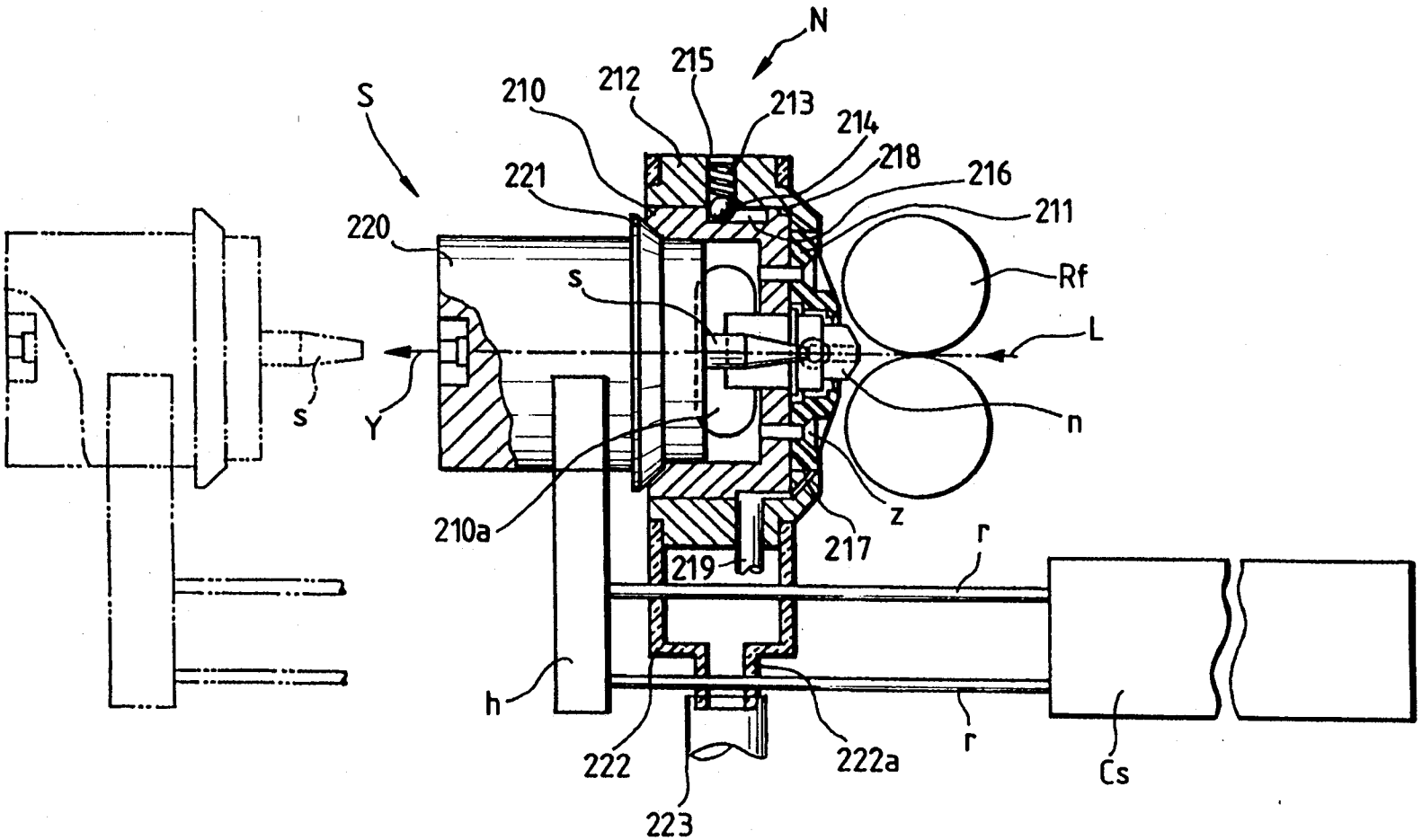
FIG. 17 is a side view of a spinning section including a partial section.
Figure 18:
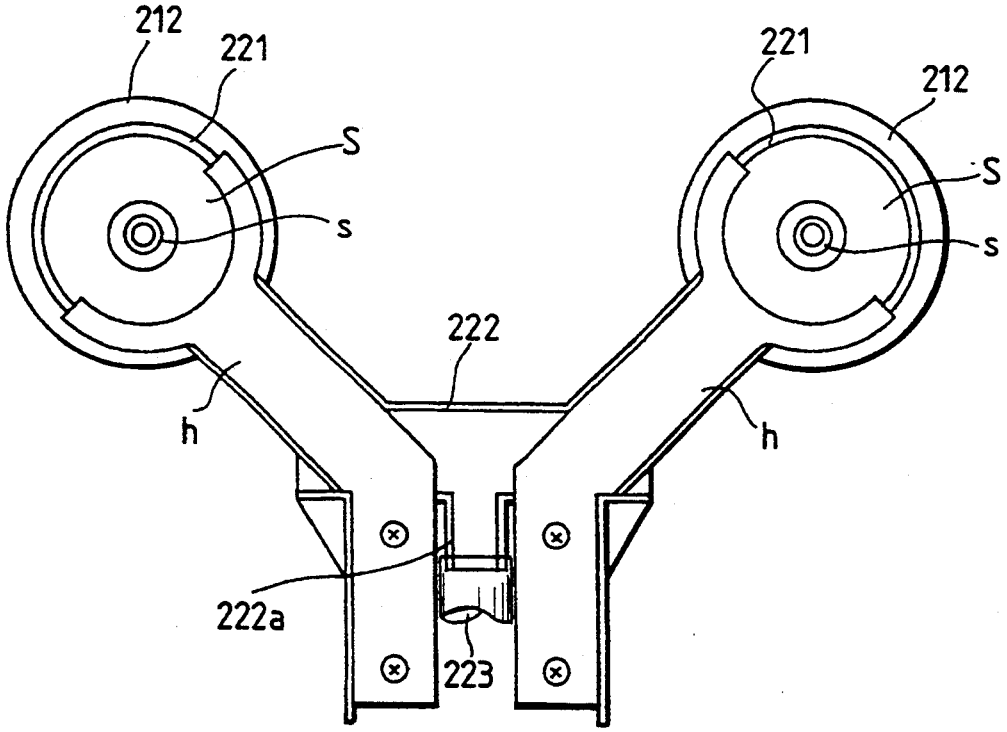
FIG. 18 is a bottom view of an adjacent 2-spindle spinning section.

First, with reference to FIG. 17 showing a side view of the spinning section Sp including a partial section and FIG. 18 showing a bottom view from the spindle member S side of the 2-spindle spinning section Sp adjacent thereto, separation means for separating the nozzle member N of the spinning section Sp from the front roller Rf, means for separating the spindle member S from the nozzle member N, cleaning means for the spinning section Sp or the like, and the spun-yarn delivery member H will be described.

The spindle member S constituting the spinning section Sp is held on the support member h at the end of the rod r of the cylinder Cs, and is joined with the nozzle member N during the spinning as indicated by the solid line in FIG. 17. When yarn breakages occur, the cylinder Cs is actuated to separate the spindle member S from the nozzle member N as indicated by the phantom lines.

The nozzle member N is composed of a nozzle cover 211 housing therein a nozzle n mounted on a nozzle casing 210 by threads z, and a nozzle housing 212 mounted on the frame of the spinning machine for slidably housing therein the nozzle casing 210. The nozzle housing 212 is formed with a through-hole 215 housing therein a coil spring 213 and a spherical body 214, said through-hole 215 being directed at the nozzle casing 210, and the corresponding nozzle casing 210 is provided with a groove 216 into which a part of the spherical body 214 can be inserted. Accordingly, normally, the nozzle casing 210 is pressed by the spherical body 214 urged by the coil spring 213 and therefore is in frictional engagement with the nozzle housing 212.

Reference numeral 217 denote a predetermined number of air blow holes formed in the nozzle housing 212 while being directed in a direction of the nozzle n. The air blow holes 217 appear by the movement of the nozzle casing 210 in the direction opposite to the front roller Rf, as will be described later, and are connected to an air supply pipe 219 through a peripheral groove 218 provided in the periphery of the nozzle casing 210. The air blow holes 217 are closed by the side wall of the nozzle cover 211 during spinning. Reference numeral 220 denotes a spindle housing for rotatably supporting the hollow spindle s, and a ring 221 is s, and a ring 221 is slightly slidably mounted on the spindle housing 220 to secure the connection between the nozzle member N and the spindle member S and also comprises a buffer at the time of connection.

Reference numeral 222 denotes a cover member which is preferably formed of a synthetic resin to cover the nozzle housing 212. The cover member 222 has one end 22*a* connected to a suction pipe 223. The nozzle casing 210 and the nozzle housing 212 are formed with holes 210*a* as shown in FIG. 17. A hole of the nozzle housing 212 is not shown in the figure. Air is sucked by the suction pipe 223 under low suction pressure during spinning, whereby the suction pipe 223 acts as an escape hole for air jetted out of the air jet holes 203 of the nozzle n and also acts to remove harmful floating fibers generated in the nozzle housing 212 during spinning.

In the spinning section Sp constructed as described above, for example, in the case where yarn breakages occur without proper supply of the sliver L being carried out because the sliver L or impurities contained in the sliver L are clogged between the front roller Rf and the end of the nozzle n or in the hollow passage 204 of the hollow spindle s, the solenoid clutch Ch of the back-roller Rb is released in accordance with the signal from the well-known yarn-breakage detector through an order from a suitable control device to stop the draft device D and stop the driving of the spinning section Sp, the winding portion W, etc.

Next, the cylinder Cs is actuated to move back the spindle member S to a position as indicated by the phantom lines to separate it from the nozzle member N. After the backward movement of or after starting the backward movement of the spindle member, compressed air is supplied from the air supply pipe 219 to the peripheral groove 218 provided in the periphery of the nozzle casing 210. Then, the nozzle casing 210 in frictional engagement with the nozzle housing 212 through the spherical body 214 moves leftwise in FIG. 17 to widen a clearance between the front roller Rf and the end of the nozzle n, and the air blow holes 217 appear so that the compressed air blow out to clean the nozzle n and blow away and clean the sliver L and the impurities contained in the sliver L, if they are clogged. Air is temporarily jetted out of the air jet holes 203 shown in FIG. 13 to clean the interior of the nozzle casing 210 also.

Figure 19:
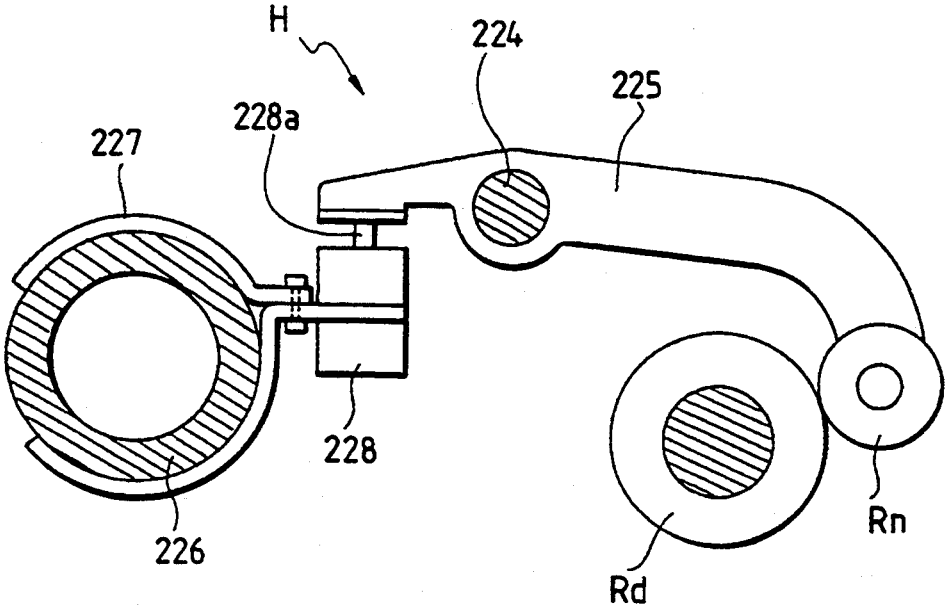
FIG. 19 is a side view of a spinning yarn feeding member.

Next, the spun yarn delivery member H will be described with reference to FIG. 19.

The nip roller Rn is pivotally mounted on one end of a lever 225 which can swing about a fixed shaft 224, and a cylinder rod 228*a* of a cylinder 228 mounted by a suitable fixing element 227 on a fixed rod 226 of the spinning machine is connected to the other end of the lever 225, the lever 225 being urged counterclockwise by a weak return spring mounted on the lever 225. In delivery of the spun yarn Y, the cylinder 228 is actuated so that the nip roller Rn is brought into contact with the delivery roller Rd being rotated and driven to deliver the spun yarn Y in the direction of the spun yarn winding section W. When yarn breakages occur, the operation of the cylinder 228 is stopped, and the lever 225 is rotated counterclockwise by the return spring whereby the nip roller Rn is separated from the delivery roller Rd rotated and driven to thereby stop the delivery of the spun yarn Y.

Figure 20:
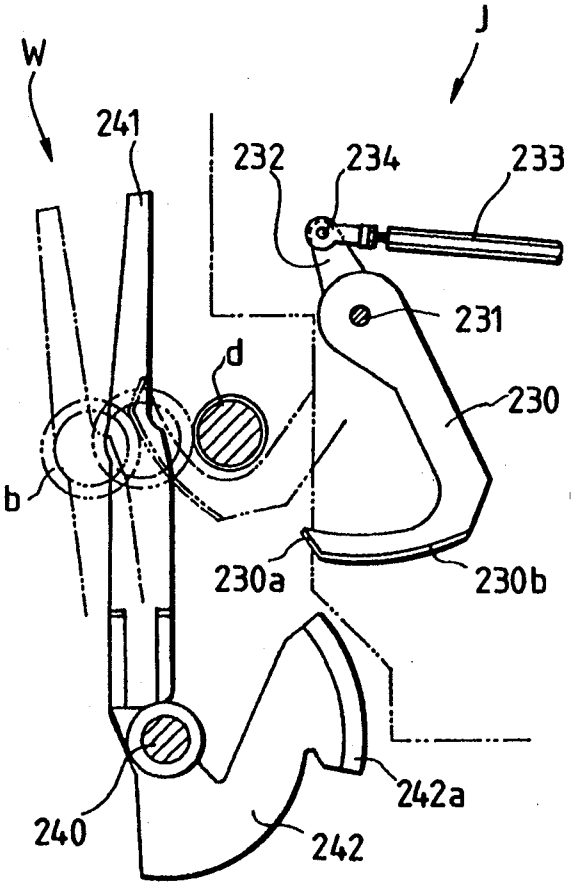
FIG. 20 is a schematic side view of a package extruding member and a winding portion.

The package extruding member J and the suction member Su which constitute the piecing apparatus P will be described mainly with reference to FIG. 15, FIG. 20 showing a side of the package extruding member J and FIG. 21 which is a perspective view showing the suction operation of the suction member Su.

Reference numeral 230 denotes a package extruding plate, which can be rotated about a fixed shaft 231 mounted on the frame of the piecing apparatus P from a standby position indicated by the solid line in FIG. 20 to a position for extruding the package b as indicated by the phantom lines. Reference numeral 232 denotes a lever mounted on the package extruding plate 230. One end of a rod 233 is pivotally mounted on the lever 232 by a pin 234, whereas the other end of the rod 233 is connected to one end of a lever 236 pivotally mounted on a fixed shaft 235 mounted on the frame of the piecing apparatus P. The lever 236 is provided at the other end with a cam follower 237, which comprises a driving source for various members of the piecing apparatus P and is in contact with one of a group of plate cams e for controlling the driving.

In FIG. 20, reference numeral 240 denotes a fixed shaft provided on the frame on the spinning machine side, and a well-known cradle arm 241 is swingingly pivotally mounted on the fixed shaft 240. Reference numeral 242 denotes a substantially fan-like package positioning lever described later mounted on the lower portion of the cradle arm 241. Reference numeral **242*a* denotes a shoe formed from a friction member such as rubber formed to be arc about the fixed shaft 240, the shoe 242*a* being attached to the package positioning lever 242**.

Figure 21:
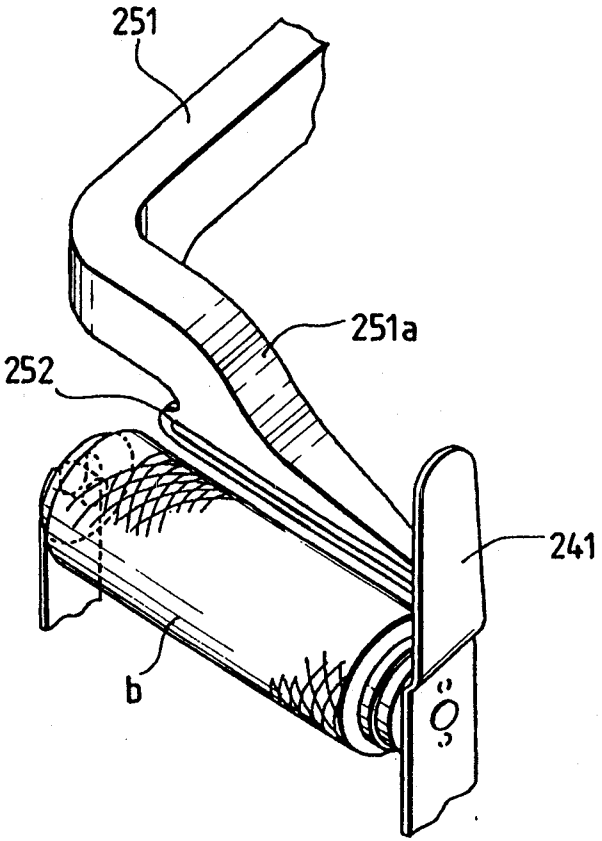
FIG. 21 is a perspective view showing a suction operation of a suction member.

The suction member Su comprises, as shown in FIG. 15, a suction pipe lever 251 rotatable about a fixed shaft 250 mounted on the frame of the piecing apparatus P from a vertical standby position shown in FIG. 15 to a position close to the surface of the package b shown in FIG. 21 and a substantially triangular action mouth **251*a* formed substantially at a right angle to the suction pipe lever 251, and a slit 252 equal in length to the package b is formed along a portion corresponding to the bottom side of a triangle of the substantially triangular suction mouth 251*a*. Although not shown, the rotation of the suction pipe lever 251 is driven and controlled through a suitable rod by a cam of a group of cams e similarly to the rotation of the package extruding plate 230** as previously mentioned.

The operation of the package extruding member J and the suction member Su will be described below.

When yarn breakages occur, a suitable one of the group of cams e is rotated in accordance with an order from a suitable control device to thereby rorate the lever 236 clockwise in FIG. 15 and move the rod 233 rightward, and the package extruding plate 230 is rotated about the fixed shaft 231 clockwise and upwardly in FIG. 20. The end **230*a* of the package extruding plate 230 comes into contact with the package b from the lower portion on the friction roller d side to move in between the package b and the friction roller d to separate the package b from the friction roller d as indicated by the phantom lines in FIG. 20. The package b comes into contact with a contact surface 230*b* of the package extruding plate 230** so that the inertia rotation stops.

After the separation of the package b from the friction roller d, the rod 260 at the standby position as indicated by the solid line is moved leftward by the rotation of the cam of the group of cams e whereby the shoe lever 261 is rotated counterclockwise about the fixed shaft 262 to bring the shoe **261*a* formed from a friction member such as rubber into contact with the shoe 242*a* of the package positioning lever 242. After withdrawal of the package extruding plate 230 to the standby position indicated by the solid line in FIG. 20, to prevent the cradle arm 241 always urged clockwise in FIG. 20** from being rotated clockwise.

Subsequently, the suction pipe lever 251 is rotated counterclockwise from the standby position shown in FIG. 15, and the slit 252 of the suction mouth **251*a* is moved close to the package b as shown in FIG. 21** to such the spun yarn Y wound into the package b.

The package reversing member Rw for reversing the package b during the suction work will be described with reference to FIG. 15.

Reference numeral 270 denotes a reversing roller installed on a free end of a swinging lever 272 pivotally mounted on a fixed shaft 271 mounted on the frame of the piecing apparatus P. A timing belt 275 is stretched between a sprocket 273 mounted on the shaft of the reversing roller 270 and a sprocket 274 pivotally mounted on the fixed shaft 271 rotated by suitable driving means such as a motor so that the sprocket 274 is rotated and driven to thereby suitably rotate the reversing roller 270 through the timing belt 275 and the sprocket 273. One end of the rod 276 is pivotally mounted on the free end of the swinging lever 272 on the side opposite to that where the reversing roller 270 is mounted, and one end of a substantially V-shaped lever 277 rotatably mounted on the fixed shaft 235 is pivotally mounted on the other end of the rod 276. A cam follower 278 in contact with the cam of the group of cams e is provided at the other end of the substantially V-shaped lever 277.

While the suction mouth **251*a* of the suction pipe lever 251 sucks the spun yarn Y wound into the package b, the cam of the group of cams e is rotated so that the rod 276 is moved rightward in FIG. 15 through the substantially V-shaped lever 277 whereby the swinging lever 272 is rotated clockwise to bring the reversing roller 270 into contact with the package b. Then, the reversing roller 270 is rotated and driven to rotate the package b in the rewinding direction so that the spun yarn Y wound into the package b is sucked by a predetermined length into the slit 252 of the suction mouth 251*a*. The reversing roller 270** need be operated as described later even after completion of the suction work of the spun yarn Y, and the contact thereof with the package b is maintained in the state where the rotation is stopped.

Next, the guide member Gu for guiding the spun yarn Y sucked into the slit 252 to a predetermined position and the transfer arm member Ta for receiving the spun yarn Y held at a predetermined position by the guide member Gu to transfer it below the spindle member S of the spinning section Sp separated from the nozzle member N will be described below.

First, the guide member Gu will be described with reference to FIG. 15, FIG. 16, and FIG. 23 which is a perspective view showing the positional relationship of the suction mouth **251*a***, the transfer arm member Ta and the guide member Gu.

As shown in FIG. 15, the guide member Gu has a guide lever 280 pivotally mounted on the frame a1 of the piecing apparatus P. A rod 281 is pivotally mounted in the middle of the guide lever 280. The rod 281 is movable left- and rightwards in FIG. 15 by the cam of the group of cams e similarly to the rod 276 pivotally mounted on the swinging lever 272 as mentioned above. For rotation from a standby position inclined rightward as indicated by the solid line in FIG. 15 to a substantially vertical operating position shown in FIG. 23, a suitable one of the group of cams e is rotated to move the rod 281 leftward whereby the guide lever 280 is rotated counterclockwise.

Figure 23:
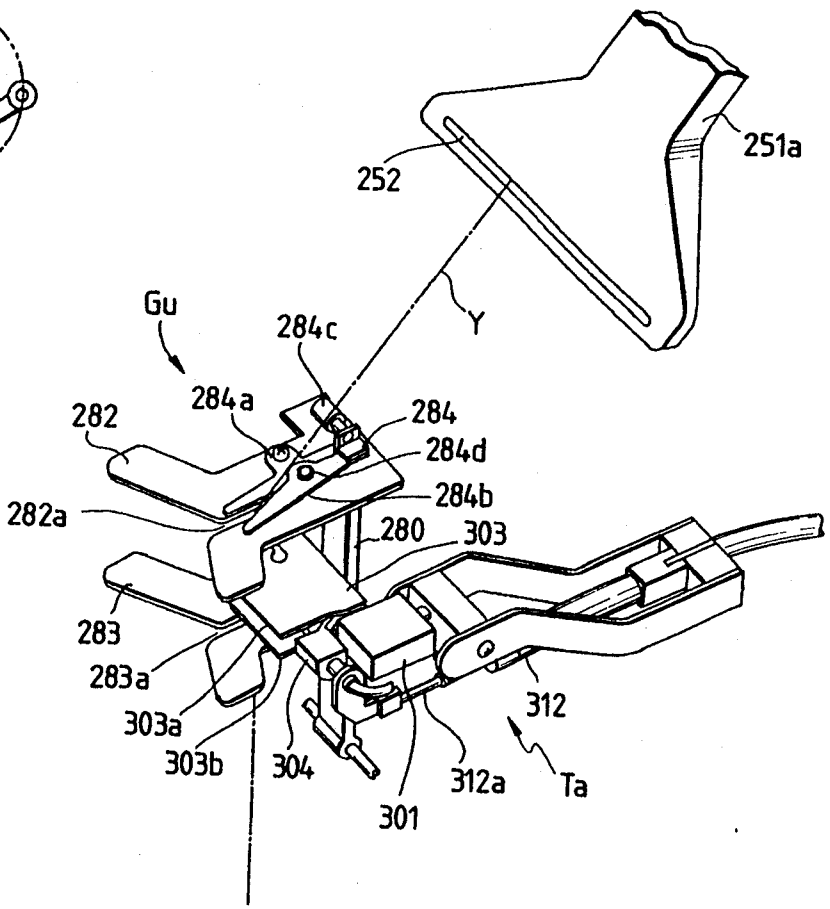
FIG. 23 is a perspective view showing a transfer arm member, a guide member and a suction mouth.
Figure 22:
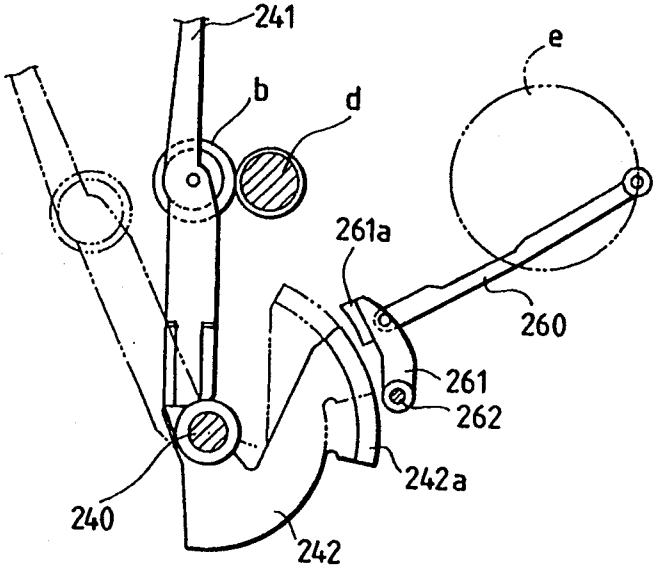
FIG. 22 is a schematic side view of a package locating member and a winding section.
Figure 27:
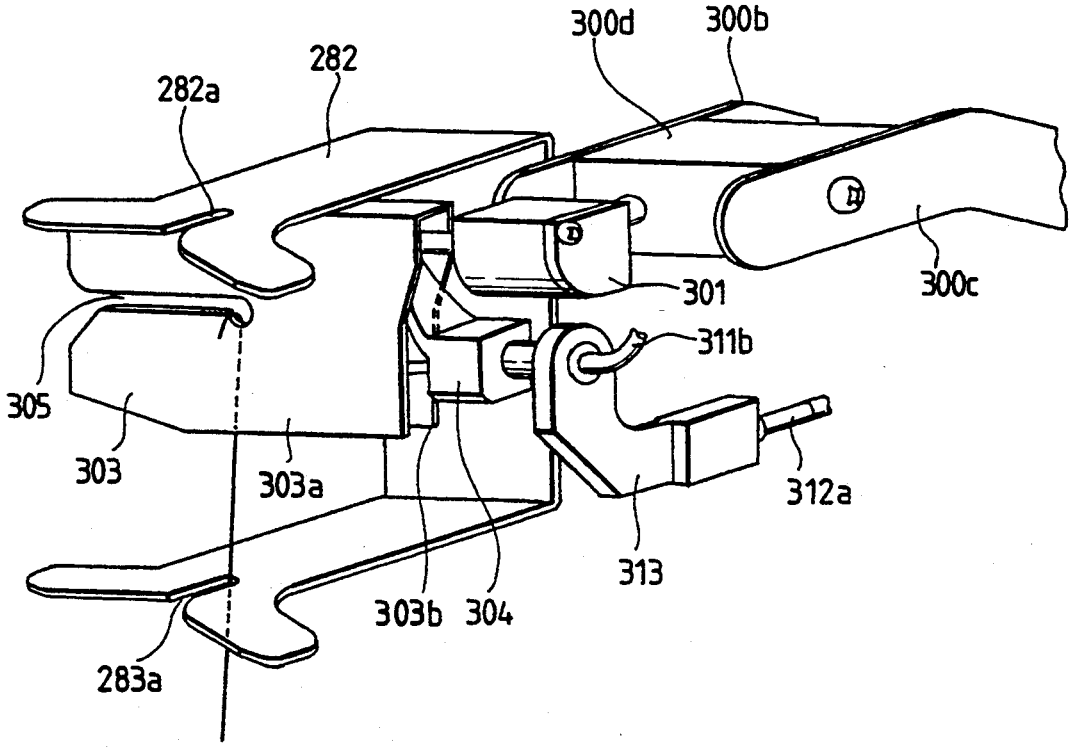
FIG. 27 is a perspective view showing a yarn finger and a guide member.

As shown in FIGS. 15 and 23, a substantially Y-shaped upper guide plate 282 having a slit 282*a* is horizontally mounted on the upper end of the guide lever 280. A substantially Y-shaped lower guide plate 283 having a slit 283*a* similar to that of the upper guide plate 282 is horizontally mounted in a spaced relation below the upper guide plate 282. A scissors-like cutter 284 comprising a fixed blade 284*a* and a movable blade 284*b* as shown in FIG. 23 is provided on the upper surface of the upper guide plate 282, the movable blade 284*b* capable of being rotated about a shaft 284*d* by suitable driving means such as an air cylinder 284. In FIG. 27, the scissors-like cutter 284 is omitted.

Next, the transfer arm member Ta will be described mainly with reference to FIG. 24 which is a perspective view of the entire transfer arm member Ta, FIG. 25 which is a front view of the transfer arm member Ta including a partial section, FIG. 26 which is a front view of a yarn finger of the transfer arm member Ta including an internal section of the yarn finger and FIG. 27 which is a perspective view of a yarn finger and a guide member Gu.

Figure 25:
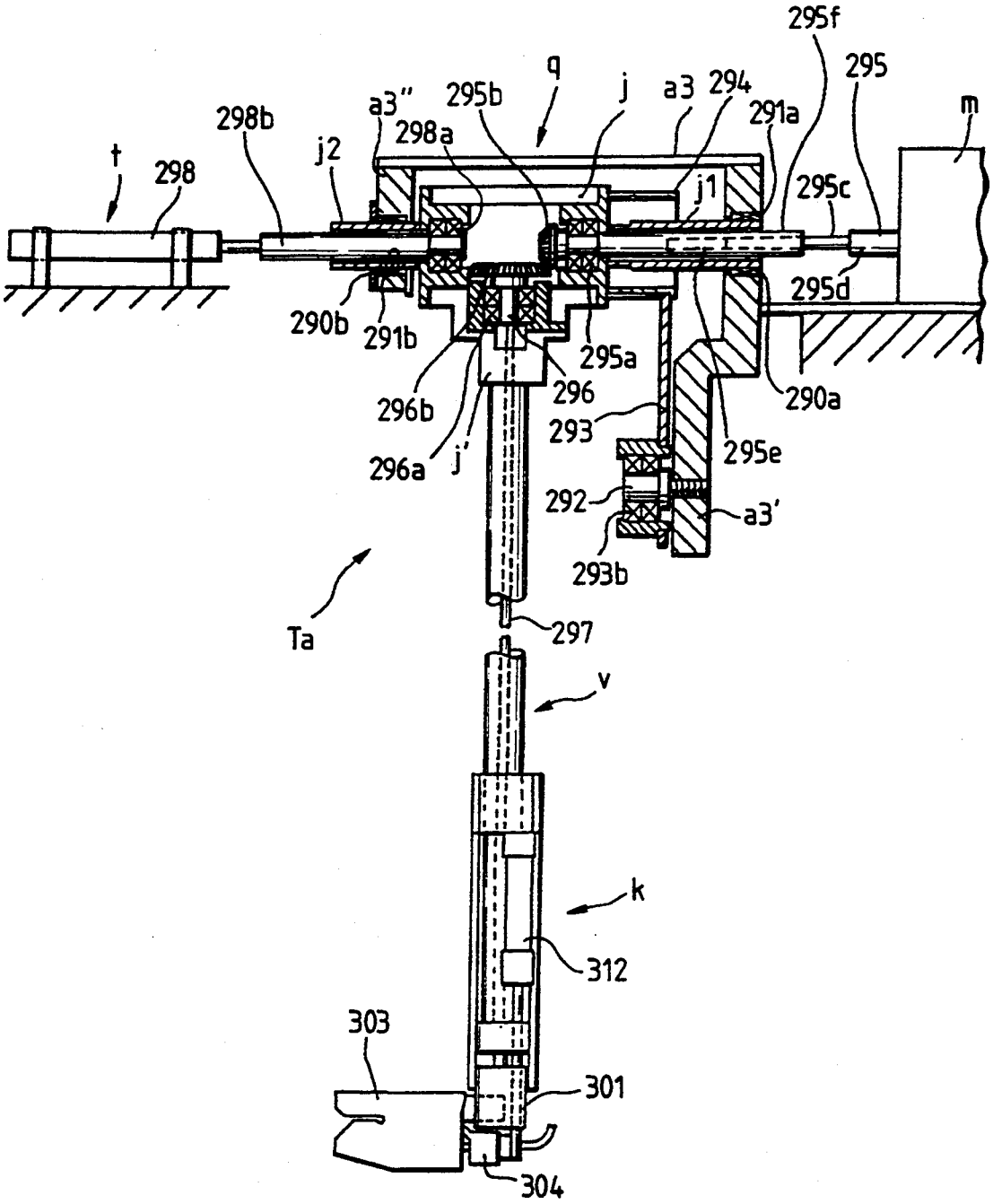
FIG. 25 is a front view of a transfer arm member including a partial section.

As shown in FIG. 15, the transfer arm member Ta is composed of a motor m installed on the frame a2 of the piecing apparatus P, an operating member q, a moving member t for moving the operating member q left- and rightwards in FIG. 16 or FIG. 25, an accel wire v and an operating head member k.

The operating member q will be described hereinafter mainly with reference to FIGS. 24 and 25.

Numeral a3 denotes a frame of the piecing apparatus P. A substantially cylindrical jacket j is provided rotatably with respect to the frame a3 by the arrangement wherein cylindrical members j1 and j2 axially extended from both ends of the substantially cylindrical jacket j are mounted on holes 291*a* and 291*b* formed in vertical frames a3′ and a3″ of the frame a3 through bearings 290*a* and 290*b*. Reference numeral 293 denotes a segment gear mounted through a bearing 293*b* on a fixed shaft 292 mounted on a vertical frame a3′ of the frame a3, the segment gear 293 being engaged with a wide gear 294 mounted on the outer wall of the substantially cylindrical jacket j. The gear 294 in engagement with the segment gear 293 is formed to be wide by a portion of movement of the substantially cylindrical jacket j so that when the substantially cylindrical jacket j moves, its movement is allowed. A rod 293*a* operated by a cam of a group of cams e is mounted in the middle of the segment gear 293. Accordingly, the segment gear 293 is suitably rotated clockwise or counterclockwise by the movement of the rod 293*a*, whereby the substantially cylindrical jacket j is suitably rotated clockwise or counterclockwise through the gear 294 in engagement with the segment gear 293.

Reference numeral 295 denotes a rotational shaft which extends through a cylindrical member j1 of the substantially cylindrical jacket j rotated and driven by the motor m. A portion in the vicinity of the end of the rotational shaft 295 is supported by a suitable bearing 295*a* and a bevel gear 295*b* is mounted on the end of the rotational shaft 295. The rotational shaft 295 is composed of a shaft portion 295*d* connected to a rotational shaft of the motor m having a shaft portion 295*c* having a square section at the end thereof, and a shaft portion 295*f* formed with a square hole 295*e* into which the shaft portion 295*c* having a square section can be inserted. With this configuration, when a cylinder 298 described later is operated, the shaft portion 295*c* having a square section slides within the square hole 295*e* of the shaft portion 295*f* to allow the movement of the substantially cylindrical jacket j. A bevel gear 296*b* in engagement with a bevel gear 295*b* is mounted on a minor shaft 296 supported by a bearing 296*a* intersecting perpendicularly to the rotational shaft 295, and an accel wire 297 housed in an accel wire member v is mounted on the side opposite to the side at which the bevel gear 296*b* of the minor shaft 296 is mounted. The bearing 296 for supporting the minor shaft 296 is arranged within a sub-jacket j′ extended from substantially the middle portion of the substantially cylindrical jacket j.

Reference numeral 298 denotes a cylinder which constitutes a moving member t having a cylinder rod 298*b* extending through a cylindrical member j2 of the substantially cylindrical jacket j, the cylinder rod 298*b* having an end mounted on a bearing 298*a*. The cylinder 298 can be actuated to thereby the substantially cylindrical jacket j left- and rightwards in FIG. 25 as mentioned above.

The operating head member k will be described hereinafter mainly with reference to FIGS. 24 and 26.

Figure 24:
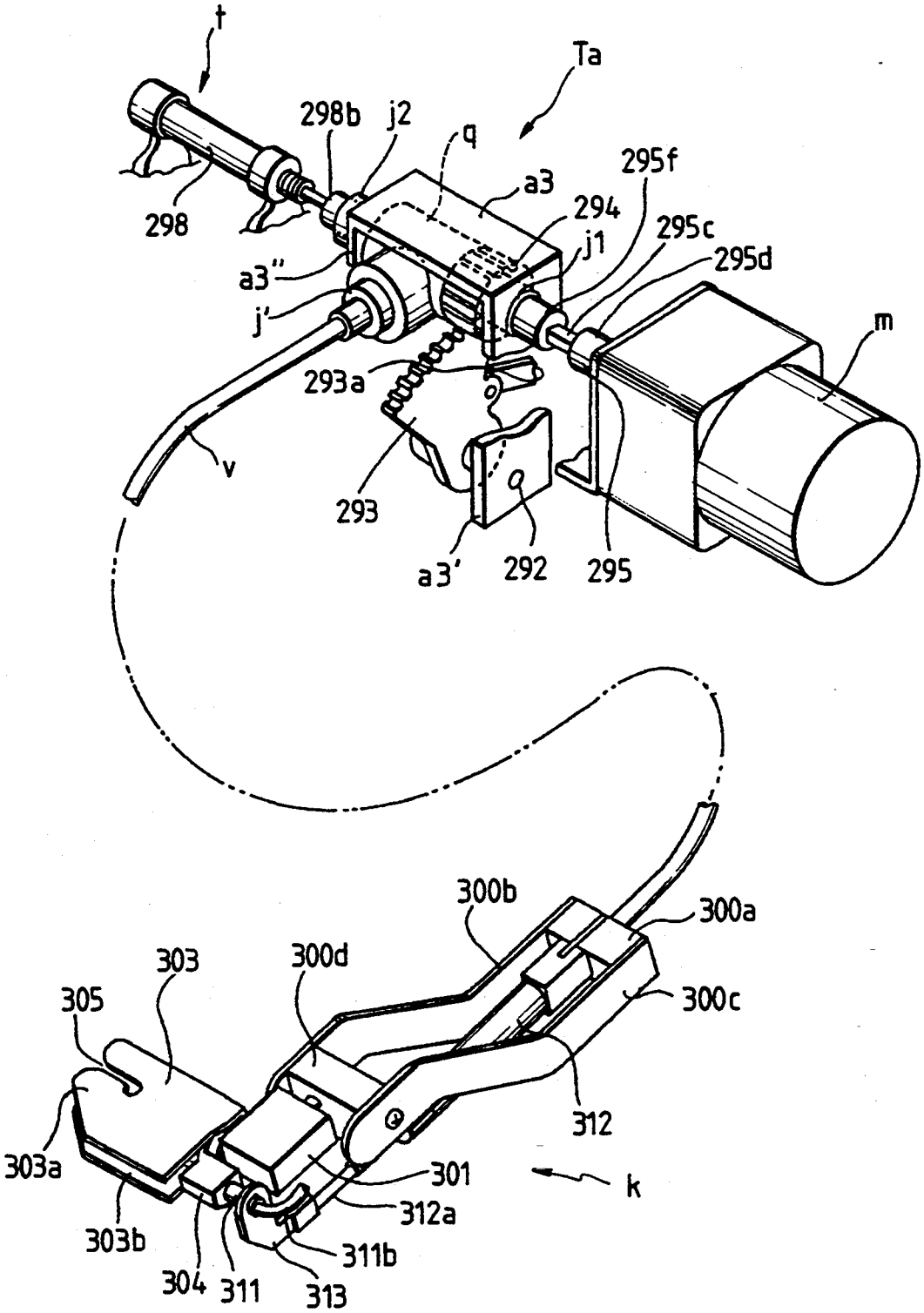
FIG. 24 is a perspective view of a transfer arm member.

In FIG. 24, reference numeral 300*a* denotes a fixed block mounted on the accel wire member v. On the fixed block 300*a* is mounted elongated side frames 300*b* and 300*c* which are substantially parallel with each other along the accel wire member v. A fixed block 300*d* is mounted in the vicinity of the ends of elongated side frames 300*b* and 300*c* on the side opposite to the fixed block 300*a*. Reference numeral 301 denotes a gear box mounted on the end of the accel wire member v which extends through the fixed blocks 300*a* and 300*d*. A bevel gear 302 mounted on the end of the accel wire 297 is arranged through a bearing 302*a* in the gear box 301.

Reference numeral 303 denotes a yarn finger formed from a plate-like member bended into a substantially U-shape as shown in FIG. 24 or FIG. 27. The yarn finger 303 is mounted on a cylinder block 304 mounted on the end of a cylinder rod described later so as to intersect perpendicularly to the elongated side frames 300*b* and 300*c*. A slit 305 extending substantially at a right angle to the elongated side frames 300*b* and 300*c* opened toward the end is provided in the vicinity of the end opposite to the cylinder block 304 of an upper plate 303*a* and a lower plate 303*b* of the yarn finger 303, the slit 305 having its open side formed to be widened to facilitate the insertion of the spun yarn Y into the slit 305.

Figure 26:
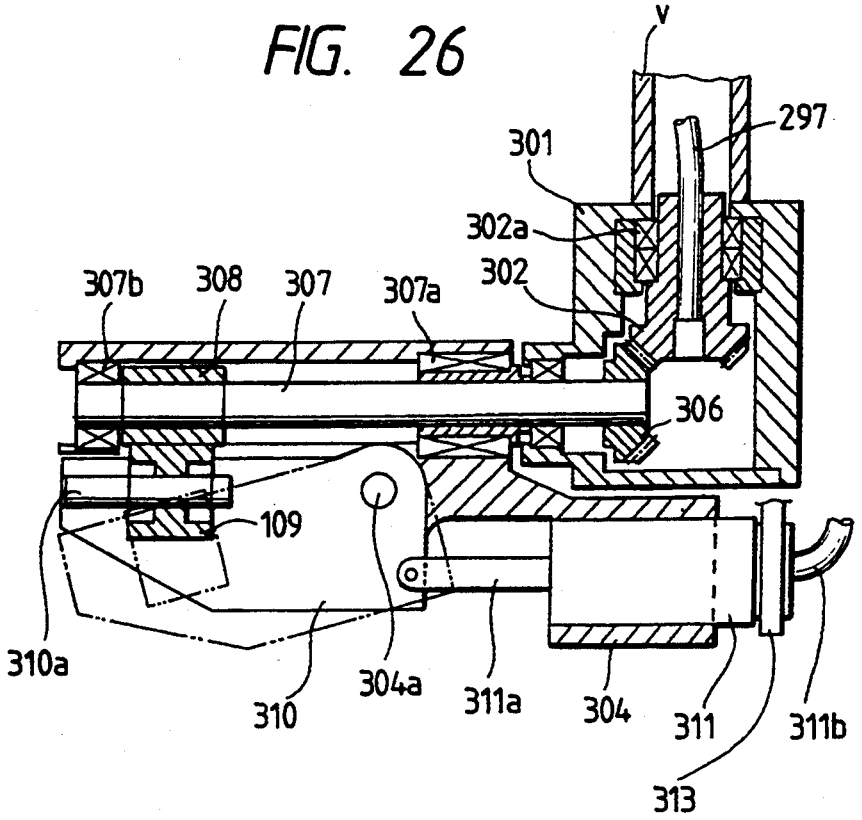
FIG. 26 is a front view including an internal section of a yarn finger.

In FIG. 26, reference numeral 306 denotes a bevel gear in engagement with a bevel gear 302 mounted on the end of the accel wire 297, the bevel gear 306 being mounted on one end of a rotational shaft 307 supported on the cylinder block 304 through bearings 307*a* and 307*b*. Reference numeral 309 denotes a feed roller mounted in the vicinity of the other end of the rotational shaft 307, and reference numeral 309 denotes a movable feed roller rotatably mounted on the shaft 310*a* installed on a substantially rectangular rotational frame 310. A shaft 304*a* installed on a cylinder block 304 is mounted at a corner opposite to the side at which the movable feed roller 309 of the rotational frame 310 is mounted. A cylinder rod 311*a* of a cylinder 311 mounted on the cylinder block 304 is pivotally mounted on the rotational frame 310 so that the rotational frame 3 can be rotated about the shaft 304*a* between a position in which the movable feed roller 309 shown at the solid line in FIG. 26 comes into contact with the feed roller 308 and a position in which the movable feed roller 309 shown at the phantom lines is moved away from the feed roller 308. Accordingly, the cylinder 311 is actuated by air supplied from the supply pipe 311*b* whereby the cylinder rod 311*a* is extruded, the rotational frame 310 is rotated clockwise about the shaft 304*a* in FIG. 26, and the movable feed roller 309 installed on the rotational frame 310 as indicated by the solid line can be brought into contact with the feed roller 308 mounted on the rotational shaft 307.

Next, the means for rotating and driving the feed roller 308 mounted on the rotational shaft 307 will be described with reference to FIGS. 25 and 26.

When the motor m is driven to rotate the bevel gear 296*b* mounted on the end of the rotational shaft 295, the bevel gear 296*b* in engagement with the bevel gear 295*b* rotates. Accordingly, the accel wire 297 secured to the minor shaft 296 mounted on the bevel gear 296*b* is rotated and driven. As shown in FIG. 26, the rotation of the accel wire 297 is transmitted to the bevel gear 302 and further transmitted to the bevel gear 306 in engagement with the bevel gear 302. Thus, the rotational shaft 307 on which the bevel gear 306 is mounted rotates. Accordingly, the feed roller 308 mounted on the rotational shaft 307 is rotated and driven.

When the cylinder 311 is actuated after insertion of the spun yarn Y in the state where the movable feed roller 309 is separated from the feed roller 308 as described later, the cylinder rod 311*a* is extruded, the rotational frame 310 is rotated clockwise in FIG. 26 about the shaft 304*a*, and the movable feed roller 309 provided on the rotational frame 310 is brought into contact with the feed roller 308 mounted on the rotational shaft 307 so that the spun yarn Y can be gripped by the feed roller 308 and the movable feed roller 309. Further, the motor m is driven in that state to rotate the accel wire 297 through the bevel gear 295*b* and the bevel gear 296*b* to transmit the rotation of the accel wire 297 to the feed roller 308 through the bevel gears 302 and 306 whereby the spun yarn Y gripped by the feed roller 308 and the movable feed roller 309 can be delivered.

In FIG. 24, reference numeral 312 designates a cylinder, one end of which is mounted on the fixed block 300*a*. A L-shaped lever 313 is mounted on the end of a cylinder rod 312*a* of the cylinder 312. An end opposite to the end on which is mounted the end of the cylinder block 312*a* of the L-shaped lever 313 is mounted on the cylinder 311 mounted on the aforesaid cylinder block 304 also shown in FIG. 26. Accordingly, when the cylinder rod 31*a* of the cylinder 312 is withdrawn from the state shown in FIG. 24, the yarn finger 303 rotates counterclockwise in FIG. 24 about the rotational shaft 307 shown in FIG. 26, and the yarn finger 303 rotates from the horizontal state to the substantially vertical state as shown in FIG. 27.

Further, in the state where the cylinder rod 298*b* of the cylinder 298 having a cylinder rod 298*b* extending through the cylindrical member j2 of the substantially cylindrical jacket j shown in FIG. 25 is extruded, that is, in the state where the jacket j is moved rightward in FIG. 25, the yarn finger 303 is at a position in which the former is away from between the upper guide plate 282 and the lower guide plate 283 of the guide member Gu. Conversely, in the state where the cylinder block 298*b* is withdrawn, that is, in the state where the jacket j is moved leftward in FIG. 25, the yarn finger 303 is inserted between the upper guide plate 282 and the lower guide plate 283 of the guide member Gu as shown in FIG. 23.

Next, the operation will be described in which the spun yarn Y inserted into the slits 282*a* and 283*a* of the upper guide plate 282 and the lower guide plate 283 of the guide member Gu sucked and held by the suction mouth 251*a* of the suction pipe lever 251 is delivered to the yarn finger 303 and cut by the scissors-like cutter 284 installed on the upper surface of the upper guide plate 282 of the guide member Gu.

The guide lever 280 of the guide member Gu in the state inclined rearwardly shown in FIG. 15 is rotated till it assumes a substantially vertical state after the suction mouth 251*a* of the suction pipe lever 251 sucks the spun yarn Y wound into the package b and before the suction pipe lever 251 is rotated upwardly.

Thereafter, the reversing roller 270 installed at the end of the swinging lever 272 is driven to rotate the suction pipe lever 251 upwardly while rewinding the spun yarn Y from the package b, whereby the spun yarn Y inserted into and held by the slit 252 of the suction mouth 251*a* is inserted into the slits 282*a* and 283*a* of the upper guide plate 282 and the lower guide plate 283 of the guide member Gu. In the state where the spun yarn Y is inserted into the slits 282*a* and 283*a* of the upper guide plate 282 and the lower guide plate 283 of the guide member Gu, the upward rotation of the suction pipe lever 251 is temporarily stopped, and the reversing roller 270 is also stopped.

The jacket j of the transfer arm member Ta in the state where the cylinder rod 298*b* of the cylinder 298 is extruded, that is, in the state where the jacket j is moved rightward in FIG. 25 is that the segment gear 293 is rotated clockwise to thereby rotate the gear 294 in engagement with the segment gear 293 so that the accel wire v is moved downward, and the yarn finger 303 is arranged substantially in the middle sideways of the upper guide plate 282 and the lower guide plate 283 of the guide member Gu.

Next, the cylinder rod 298*b* of the cylinder 298 is withdrawn to move the jacket j leftward in FIG. 25 whereby as shown in FIG. 23, the yarn finger 303 is inserted into the upper guide plate 282 and the lower guide plate 283 of the guide member Gu to introduce the spun yarn Y held within the slits 282*a* and 283*a* of the upper guide plate 282 and the lower guide plate 283 of the guide member Gu into the slit 305 of the yarn finger 303. At this time, the movable feed roller 309 is remoted from the feed roller 308 as mentioned above. Accordingly, the spun yarn Y introduced into the slit 305 of the yarn finger 303 is to be positioned between the feed roller 308 and the movable feed roller 309.

The cylinder 311 is actuated to extrude the cylinder rod 311*a*, whereby the rotational frame 310 is rotated clockwise in FIG. 26 about the shaft 304*a* to bring the movable feed roller 309 mounted on the rotational frame 310 into contact with the feed roller 308 mounted on the rotational shaft 307 so that the spun yarn Y is gripped by the feed roller 308 and the movable feed roller 309. After the spun yarn Y has been gripped by the feed roller 308 and the movable feed roller 309, the movable blade 284*b* mounted on the upper surface of the upper guide plate 282 is rotated by the actuation of the air cylinder 284c so that the spun yarn Y is cut by the scissors-like cutter 284. After the spun yarn Y is cut, the guide member Gu is returned to its original inclined standby position as shown in FIG. 15. The cut spun yarn Y on the suction mouth 251a side is sucked by the suction mouth 251a and removed. Thereafter the suction lever 251 returns to the standby position as shown in FIG. 15.

The yarn finger 303 in which the spun yarn Y is gripped by the feed roller 308 and the movable feed roller 309 is rotated about the rotational shaft 307 by the actuation of the cylinder 312 and rotated in substantially the vertical state as shown in FIG. 27. Thereafter, the segment gear 293 is rotated counterclockwise in FIG. 24 to rotate the gear 294 in engagement with the segment gear 293 so that the accel wire member v is moved upward and the yarn finger 303 is moved close to a portion below the spindle member S separated from the nozzle member N of the spinning section Sp. The spun yarn Y is rewound from the package b by the amount necessary to again rotate and drive the reversing roller 270 so that the yarn finger 303 is moved close to the portion below the spindle member S separated from the nozzle member N of the spinning section Sp. At the time of the upward movement of the yarn finger 303 close to the portion below the spindle member S or after the movement thereof close to the portion below the spindle member S, the cylinder 298 shown in FIG. 24 is actuated to once move the jacket k rightward and again move it leftward whereby the spun yarn Y is traversed through one reciprocation so that the spun yarn Y is inserted between the delivery roller Rd and the remoted nip roller Rn, which is preferable. It is of course that a separate movable guide can be provided so that the spun yarn Y can be inserted between the delivery roller Rd and the nip roller Rn.

Figure 29:
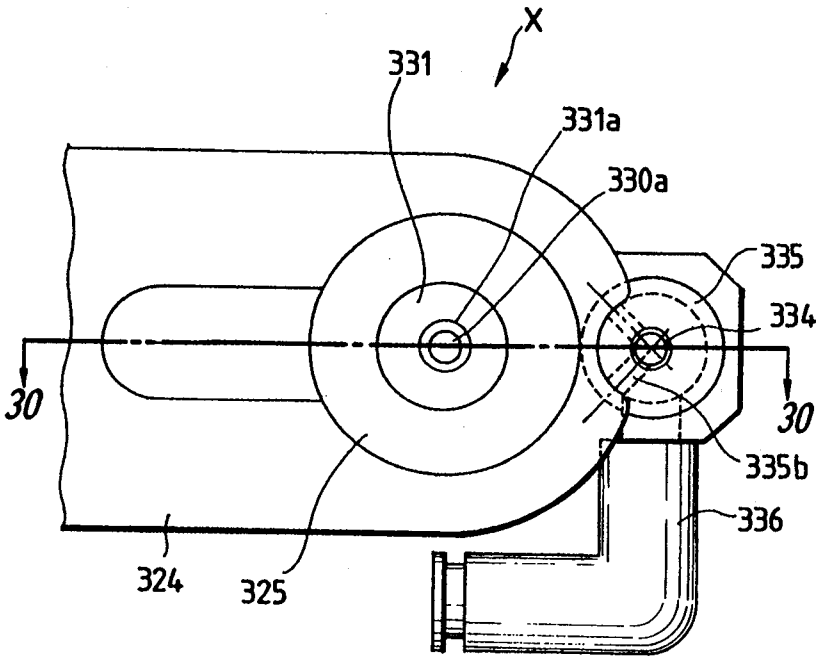
FIG. 29 is a bottom view of an air sucker body.
Figure 30:
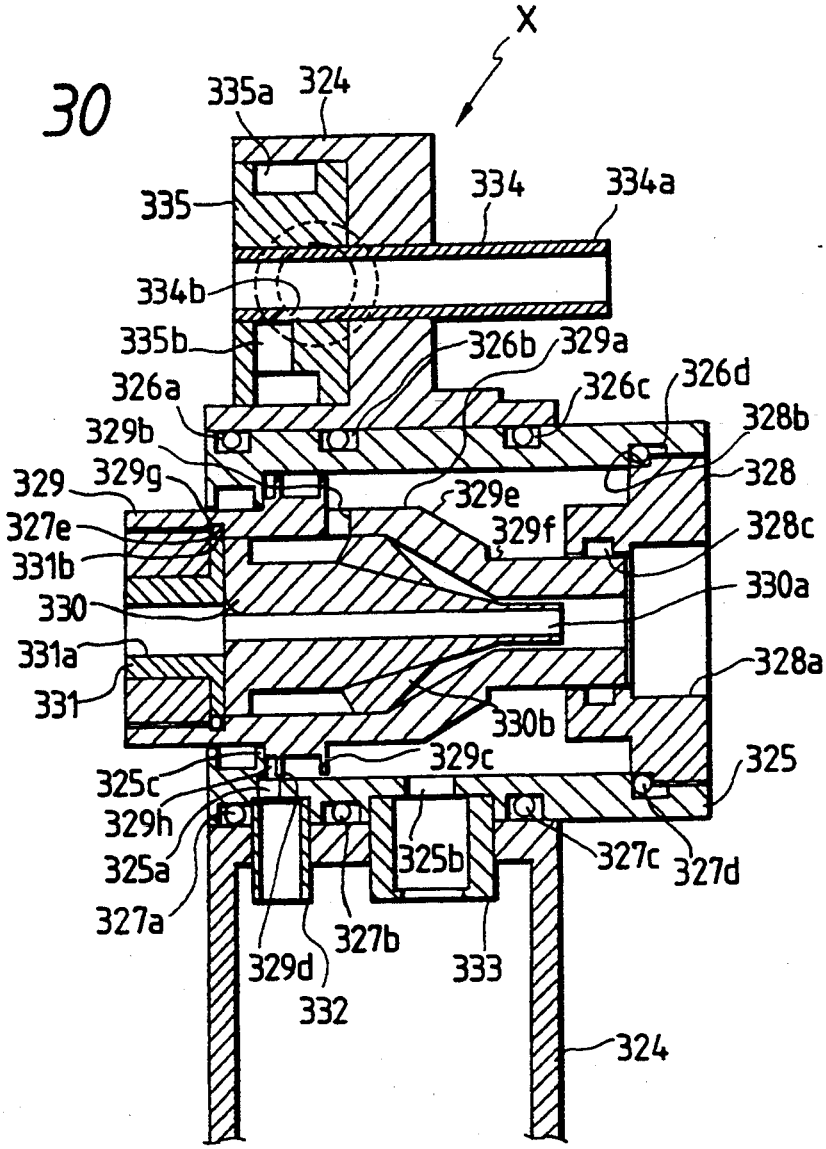
FIG. 30 is a sectional view of an air sucker body taken along line I—I of FIG. 29.

The air sucker member As will now be described with reference to FIG. 15, FIG. 28 which is a side view of the air sucker member As, FIG. 29 which is a bottom view of the air sucker body x, and FIG. 30 which is a sectional view taken along line I—I of FIG. 29 of the air sucker body x.

Figure 28:
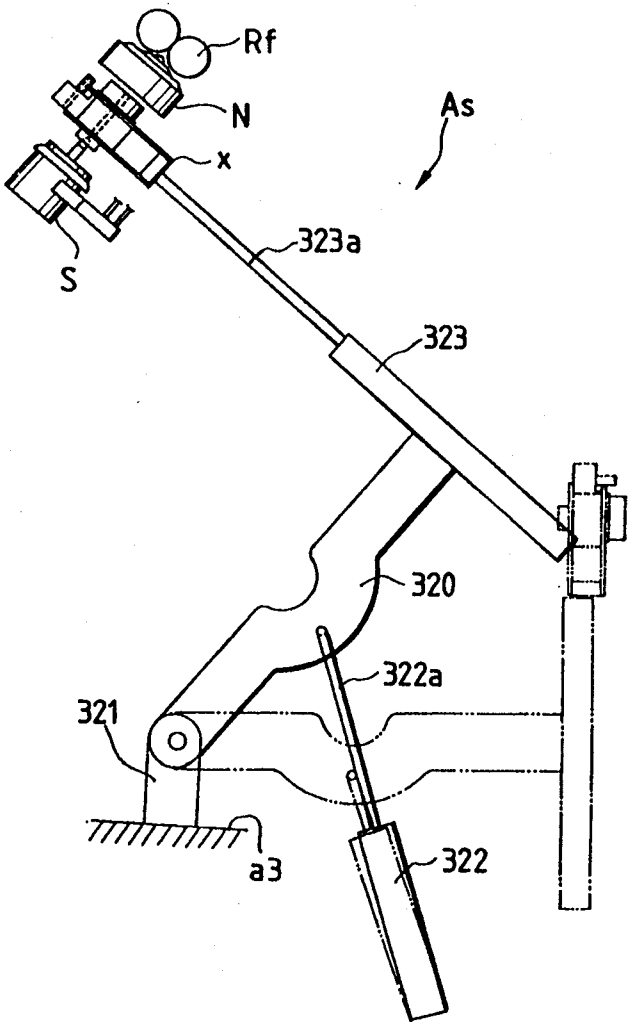
FIG. 28 is a side view of an air sucker member.

As shown in FIG. 15, one end of a lever 320 of the air sucker member As is pivotally mounted on a support column 321 mounted on a frame a2 of the piecing apparatus P, and a cylinder rod 322a of a cylinder 322 mounted for swinging on the frame a2 of the piecing apparatus P is likewise pivotally mounted substantially in the middle of the lever 320 so that the cylinder rod 322a can be extruded to rotate the lever 320 from a standby position indicated by the phantom lines in FIG. 28 to an operating position shown by the solid line.

Reference numeral 323 denotes a cylinder mounted on the free end of the lever 320 in a direction substantially intersecting perpendicularly to the lever 320, and the air sucker body x is mounted on the end of the cylinder rod 323a of the cylinder 323. In the state where the cylinder rod 322a of the cylinder 322 is extruded to rotate the lever 320 from a standby position shown by the phantom lines in FIG. 28 to an operating position shown by the solid line, when the cylinder rod 323a of the cylinder 323 is extruded, a sliding nozzle 329 described later of the air sucker body x is arranged at a position capable of being fitted to an end 202 of a hollow spindle s above the spindle member S separated from the nozzle member N of the spinning section Sp. The cylinder rod 323a of the cylinder 323 is withdrawn by a predetermined amount, the center of an opening pipe 334 described later of the air sucker body x assumes a distance capable of suitably set to the center of the hollow spindle s.

The air sucker body x will be described hereinafter mainly with reference to FIGS. 29 and 30.

Reference numeral 324 denotes a frame of the air sucker body x mounted on the end of the cylinder rod 323a of the cylinder 323. A hollow cylindrical member 325 is mounted on the frame 324, and O-rings 327a, 327b and 327c are inserted into peripheral grooves 326a, 326b and 326c provided in the outer periphery of the cylindrical member 325. Reference numeral 328 denotes a cylindrical cover for the cylindrical member 325, the cylindrical cover 328 being formed with a through-hole 328a. The O-ring 327d is inserted between a peripheral groove 326d provided in the inner periphery of the cylindrical member 325 and a small diameter portion 328b provided in the outer periphery of the cylindrical cover 328. Reference numeral 329 denotes a sliding nozzle arranged within the hollow cylindrical member 325, the sliding nozzle 329 being formed in a cylindrical side wall 329a with a hole 329b. Reference numerals 329c and 329d denote ring members projected in the cylindrical outer wall 329a so as to intersect perpendicularly to the cylindrical outer wall 329a and arranged close to the inner wall of the hollow cylindrical member 325. A member having a suitable coefficient of friction not shown is inserted in a space between the ring members 329c, 329d and the cylindrical member 325 so that the sliding nozzle 329 is not easily moved due to an inclination of the air sucker body x or the like. Such a space may be suitably provided as needed in a cylindrical cover 328 or the like as shown at 328c in FIG. 30, and a member having a suitable coefficient of friction can be inserted therein. The outer wall of the sliding nozzle 329 is constituted by a cylindrical outer wall 329f smaller in diameter than that of a conical outer wall 329e and a cylindrical outer wall 329a continuous to a cylindrical outer wall 329a, and a small diameter cylindrical outer wall 329f is inserted into a through-hole 328a so as not to contact with the inner wall of the through-hole 328a of the cylindrical cover 328.

Reference numeral 330 denotes a substantially conical internal nozzle formed with a threading hole 330a provided within the sliding nozzle 329, and a suitable number of fins 330b parallel with the axis of the internal nozzle 330 are provided on the outer wall of the internal nozzle 330. Reference numeral 331 denotes a cylindrical cover mounted on the sliding nozzle 329, the cylindrical cover 331 being formed with a through-hole 331a. An O-ring 327e is inserted between a peripheral groove 329g provided in the inner periphery of the sliding nozzle 329 and a small diameter portion 331b provided in the outer periphery of the cylindrical cover 331.

Reference numerals 332 and 333 denote air supply pipes mounted on a frame 324 opposedly of holes 325a and 325b formed in the hollow cylindrical member 325. The hole 325a formed in the air supply pipe 332 and the cylindrical member 325 is formed to be opposed to a space 329h formed by the ring member 329d projected on the cylindrical outer wall 329a of the sliding nozzle 329 and the edge 325c of the cylindrical member 325.

Reference numeral 334 denotes an opening pipe. The opening pipe 334 has one end 334a projected from the frame 324. In the vicinity of the other end of the opening pipe 334 is formed a hole 334b inclined in the direction of the projecting end 334a of the opening pipe 334. Reference numeral 335 denotes an intermediate cylindrical member mounted between the opening pipe 334 and the frame 324, said intermediate cylindrical member having a hole 335*b* in the periphery thereof capable of being communicated with a recess 335*a* and a hole 334*b* formed in the opening pipe 334. Reference numeral 336 denotes an air supply pipe. Preferably, the intermediate cylindrical member 335 is formed with a further hole 335*b* capable of being communicated with the hole 334*b* formed in the opening pipe 334 at a location having an angle of 90° so that the opening pipe 334 is rotated by 90° so as to switch a turning direction of a turning air current generated within the opening pipe 334.

The sliding nozzle 329 of the air sucker body x having the construction as described above is normally encased in a completely hollow cylindrical member 325. But, when the sliding nozzle 329 of the air sucker body x is arranged at a position capable of being fitted to the hollow spindle s above the spindle member S separated from the nozzle member N of the spinning section Sp, when compressed air is first supplied to the air supply pipe 333, the compressed air is fed into the space formed between the sliding nozzle 329 and the hollow cylindrical member 325 presses the ring member 329*c* projected on the cylindrical outer wall 329*a* of the sliding nozzle 329 to move the sliding nozzle 329 leftward in FIG. 30 so that the cylindrical cover 331 mounted on the sliding nozzle 329 is projected from the hollow cylindrical member 325, and the end 202 of the hollow spindle s is fitted with the through-hole 331*a* of the cylindrical cover 331, said fitting capable of stopping the inertia rotation of the hollow spindle s.

The compressed air supplied from the air supply pipe 333 enters the space formed between the sliding nozzle 329 and the internal nozzle 330 from the hole 329*h* formed in the cylindrical side wall 329*a* of the sliding nozzle 329 with the cylindrical cover 331 projected from the hollow cylindrical member 325 and is discharged from the through-hole 328*a* formed in the cylindrical cover 328, because of which a suction air current is generated in the threading hole 330*a* of the internal nozzle 330. Fins 330*b* provided on the outer wall of the internal nozzle 330 are provided to prevent air flowing into a space formed between the sliding nozzle 329 and the internal nozzle 330 from being a turning air current. When the suction air current is changed into a turning air current, the spun yarn Y opened by the opening pipe 334 in the succeeding step after the yarn has been introduced cannot be maintained in a natural state, and in addition, there arises a trouble such that the spun yarn Y inserted into the threading hole 330*a* is untwisted and cut.

As described above, when the feed roller 308 of the yarn finger 303 arranged close to a portion below the spindle member S and gripping the spun yarn Y is rotated to deliver the spun yarn Y, in the state where the suction air current is generated in the threading hole 330*a* of the internal nozzle 330, the spun yarn Y is inserted into the hollow passage 204 of the hollow spindle s by the action of the suction air current. When the feed roller 308 of the yarn finger 303 is rotated to deliver the spun yarn Y, the reversing roller 270 is again driven to rewind the spun yarn Y by the length as required from the package b.

When the spun yarn Y is moved by the predetermined length required for piecing from the end 202 of the hollow spindle s, the rotation of the feed roller 308 of the yarn finger 303 is stopped to stop a delivery of the spun yarn Y and a supply of compressed air to the air supply pipe 333 mounted on the hollow cylindrical member 325 is stopped to supply compressed air to the air supply pipe 332. When the rotation of the feed roller 308 of the yarn finger is stopped, the driving of the reversing roller 270 is also stopped. The compressed air supplied to the air supply pipe 332 enters the space 329*h* formed by the ring member 329*d* and the edge 325*c* of the cylindrical member 325 to press the ring member 329*d* so that the sliding nozzle 329 is moved rightward in FIG. 30, and the cylindrical cover 331 mounted on the sliding nozzle 329 is housed into the cylindrical member 325.

Subsequently, the cylinder rod 323*a* of the cylinder 323 of the air sucker member As is withdrawn till the spun yarn Y is introduced into the hollow passage 204 and the spun yarn Y assumes the distance suitably set from the center of the hollow spindle s projected by the predetermined length from the end 202. Then, the compressed air from the air supply pipe 336 is fed into the hole 334*b* formed in the opening pipe 334 via the recess 335*a* of the intermediate cylindrical member 335 to thereby generate a turning air current in the direction opposite to the twisting direction of the spun yarn Y within the opening pipe 334 so that the end of the spun yarn Y which appears by a predetermined length from the end 202 of the hollow spindle s is untwisted to form an ear-like end in which the fibers are opened. When the ear-like end in which the fibers are opened, a supply of compressed air from the air supply pipe 336 is stopped so that the cylinder rod 323*a* of the cylinder 323 is withdrawn and the cylinder rod 322*a* of the cylinder 322 is also withdrawn to move the air sucker member As to the standby position indicated by the phantom lines in FIG. 28.

Then, the cylinder Cs is actuated to withdraw the rod r and the spindle member S is joined to the nozzle member N as shown in FIG. 17. At this time, also, the feed roller 308 of the yarn finger 303 is rotated so that the opened ear-like end appearing by a predetermined length from the end of the hollow spindle s may maintains its length to deliver the spun yarn Y, and the reversing roller 270 is driven to rewind the spun yarn Y from the package b. Thereafter, the reversing roller 309 is released from the feed roller 308 and the jacket j is moved rightward in FIG. 25 so that the spun yarn Y inserted into the slit 305 of the yarn finger 303 is pulled out. After this, the segment gear 293 is rotated clockwise to thereby rotate the gear 294 meshed with the segment gear 293 so that the accel wire member v is moved downward and returned to the standby position while the reversing roller 270 is withdrawn to the standby position. The shoe lever 261 is rotated clockwise about the fixed shaft 262 to move the shoe 261*a* from the shoe 242*a* of the package positioning lever 242 and the package b is again brought into contact with the friction roller d.

In such a state, the hollow spindle s is rotated in a break-in manner at a low speed. The solenoid clutch Ch is connected to start the back-roller Rb and the third roller Rt, thus starting a supply of the sliver L. After passage of a predetermined period of time after the supply of the sliver L has started, the hollow spindle s is full-rotated and the compressed air is jetted out of the air jet hole 203 of the nozzle n to generate the high-speed turning air current and the spinning starts. Simultaneously with the start of spinning, the nip roller Rn being separated from the delivery roller Rd is brought into contact with the delivery roller Rd. The friction roller d is rotated to start winding of the spun yarn Y whereby a newly supplied fiber is joined to the opened yarn end of the spun yarn Y to form a continuous yarn, which is spun.

The solenoid clutch Ch for driving or stopping the back-roller Rb and the third roller Rt of each spinning unit U involves an unavoidable difference in performance. Even if a connection signal is sent from a predetermined control device to the solenoid clutch Ch in order to drive the back-roller Rb and the third roller Rt, the time at which the back-roller Rb and the third roller Rt are actually operated is uneven by the solenoid clutches Ch.

Accordingly, for example, even if an arrangement is made wherein the hollow spindle s is full-rotated after a given period of time after issuance of the solenoid clutch Ch connection signal, compressed air is jetted out of the air jet hole 3 of the nozzle n to generate a high speed turning air current and spinning restarts, when the operation of the solenoid clutch Ch is delayed, the amount of the sliver L supplied when spinning restarts, that is, the hollow spindle s is full-rotated and the spinning section Sp is regularly driven is less than that is normally supplied. Therefore, the spinning yarn Y to be spun is thin till the sliver L assumes a normal supply amount, and accordingly, yarn breakages often occur. There arises a further inconvenience such that since the spinning yarn Y is thinner than the normal case, the spinning yarn Y is forcibly cut by the slub catcher Z. Conversely, in the case where the operation of the solenoid clutch Ch is quick, the spinning yarn Y becomes thick since the amount of sliver L supplied till the spinning restarts, resulting in inconveniences such that the spinning yarn Y is forcibly cut by the slub catcher Z or the extra sliver L becomes clogged in the hollow passage 204 of the hollow spindle s to again stop spinning.

The above-mentioned problems can be solved by the arrangement wherein the driving of the back-roller Rb and the third roller Rt at the time of restarting spinning is carried out by the driving device arranged on the piecing apparatus P and after passage of a predetermined period of time, the first mode is switched to the normal driving of the back-roller Rb and the third roller Rt through the solenoid clutch Ch.

For example, a suitable driving source such as a motor is installed on the piecing apparatus P, and a driving shaft of the driving source is made to be moved to and away from the rotational shafts of the back-roller Rb and the third roller Rt whereby the driving of the back-roller Rb and the third roller Rt for restarting a supply of the sliver L is first carried out by the driving source installed on the piecing apparatus P, thus solving the problem as mentioned above caused by the difference of the solenoid clutches Ch.

Preferably, in switching the driving of the back-roller Rb and the third roller Rt by the driving source installed on the piecing apparatus P to the normal driving of the back-roller Rb and the third roller Rt through the solenoid clutch Ch, the solenoid clutch Ch is connected at the predetermined time before the actual switching time to remove the unevenness of the operation of the solenoid clutches Ch. Further, the number of revolutions of the driving source installed on the piecing apparatus P is controlled through a suitable control device to control the supply amount of the sliver L correctly so as to prevent the piecing portion from being thin or thick.

Finally, only the operating order of the nozzle member N, the spindle member S and the cylinder Cs which constitute the spinning section Sp, and the air sucker member As and the transfer arm member Ta which are main members constituting the piecing apparatus P will be briefly described with reference to FIGS. 31 to 36. The suction of the spun yarn Y wound into the package b, the guide of the rewound spun yarn Y, and the driving of the reversing roller 270 will be omitted since they are already mentioned above.

Figure 31:
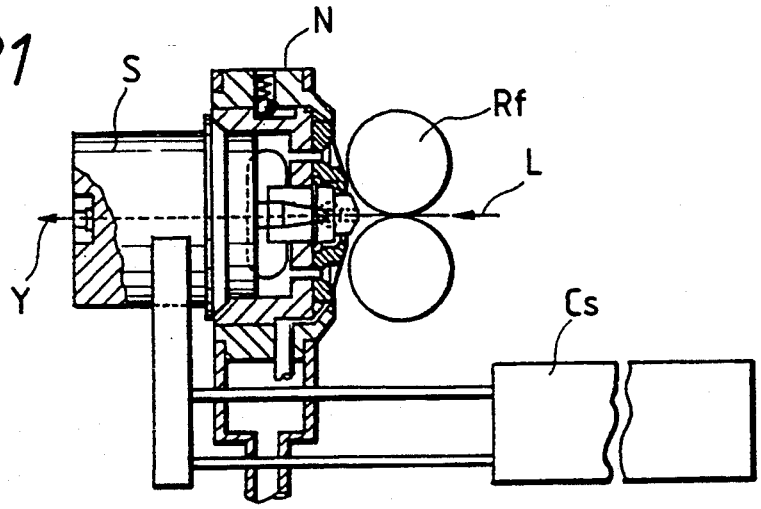
Figure 32:
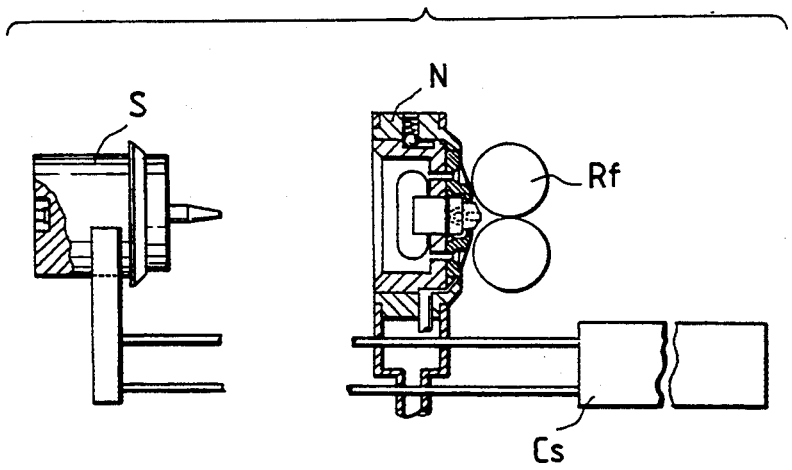

FIG. 31 shows the state where the nozzle member N and the spindle member S which constitute the spinning section Sp are joined and the spinning yarn Y is normally spun.

When end breakages occur, the cylinder Cs is actuated to move the spindle member S from the nozzle member N, and air is blown against the nozzle member N to clean it (FIG. 31).

Figure 33:
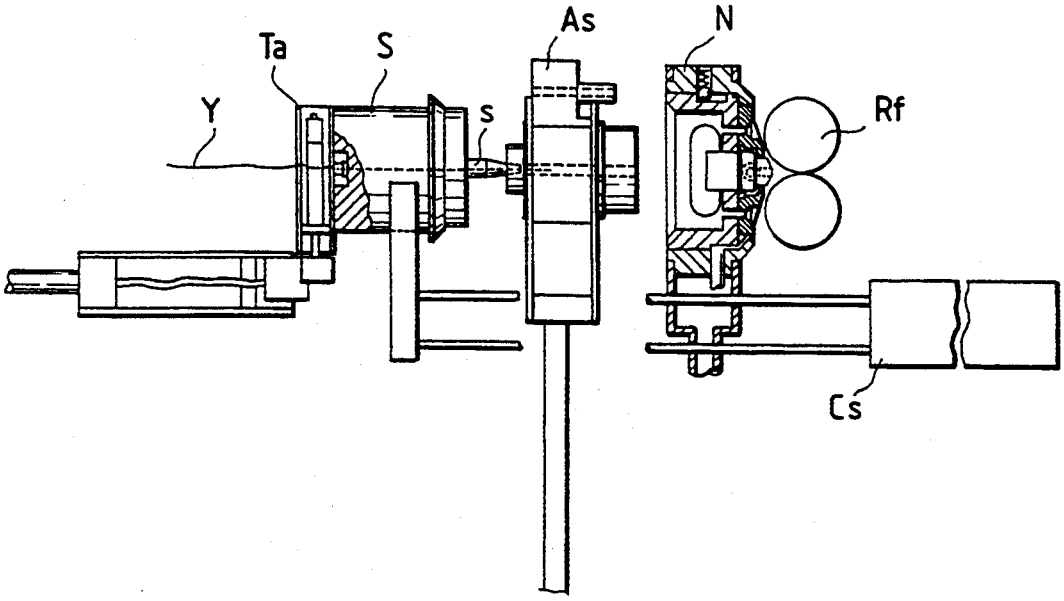

The air sucker member As is actuated to arrange the sliding nozzle 329 of the air sucker member As above the hollow spindle s of the spindle member S. Thereafter, the transfer arm member Ta which grips the spun yarn Y rewound from the package b is arranged close to and below the spindle member S, and the spun yarn Y gripped by the transfer arm member Ta due to the suction of the sliding nozzle 329 of the air sucker As is inserted into the hollow spindle s (FIG. 33).

Figure 34:
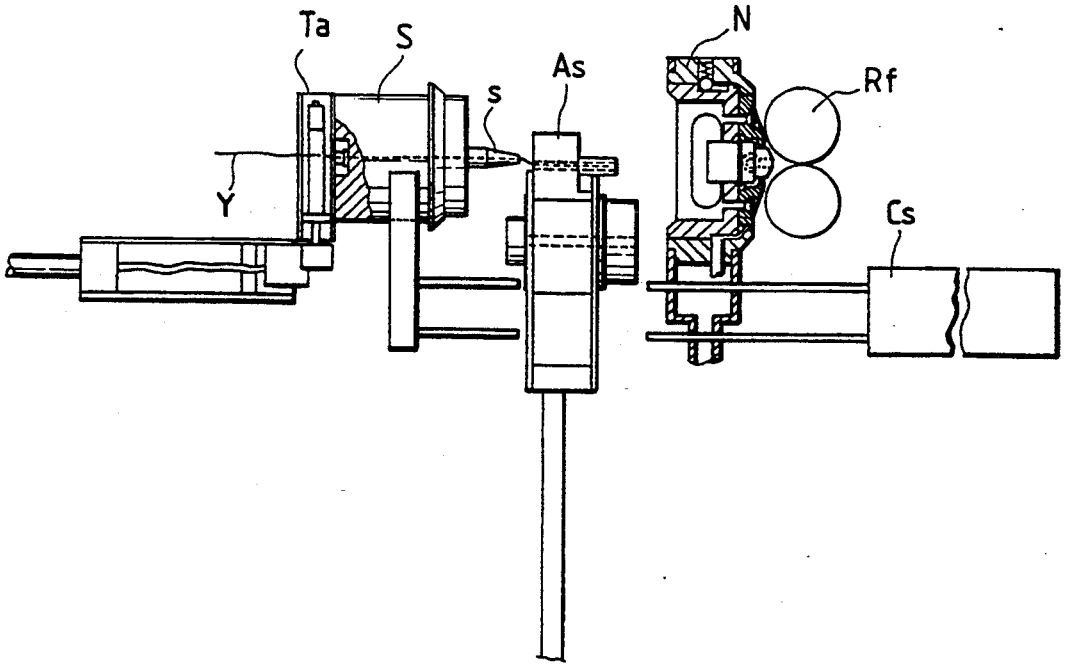
Figure 35:
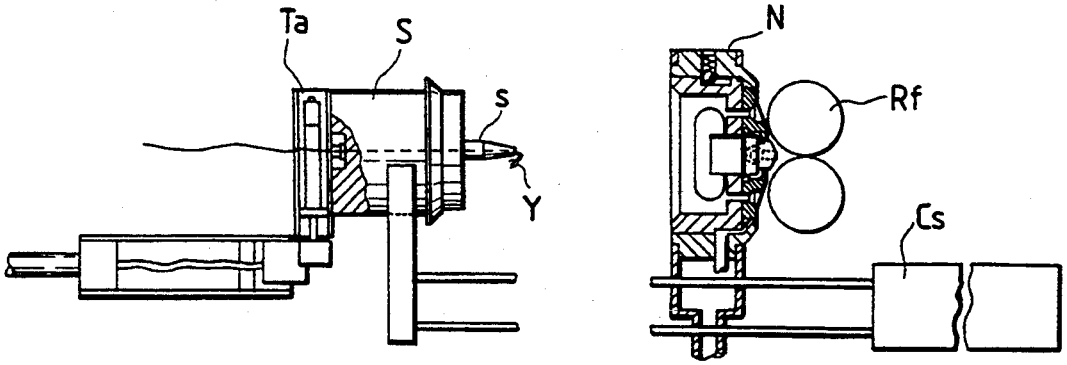

The spun yarn Y inserted into the hollow spindle s and drawn by a predetermined length from the end of the hollow spindle s is inserted into the opening pipe 334 of the air sucker member As by downward movement of the air sucker member As and the end of the spun yarn is opened to form an ear-like shape (FIGS. 34 and 35).

Figure 36:
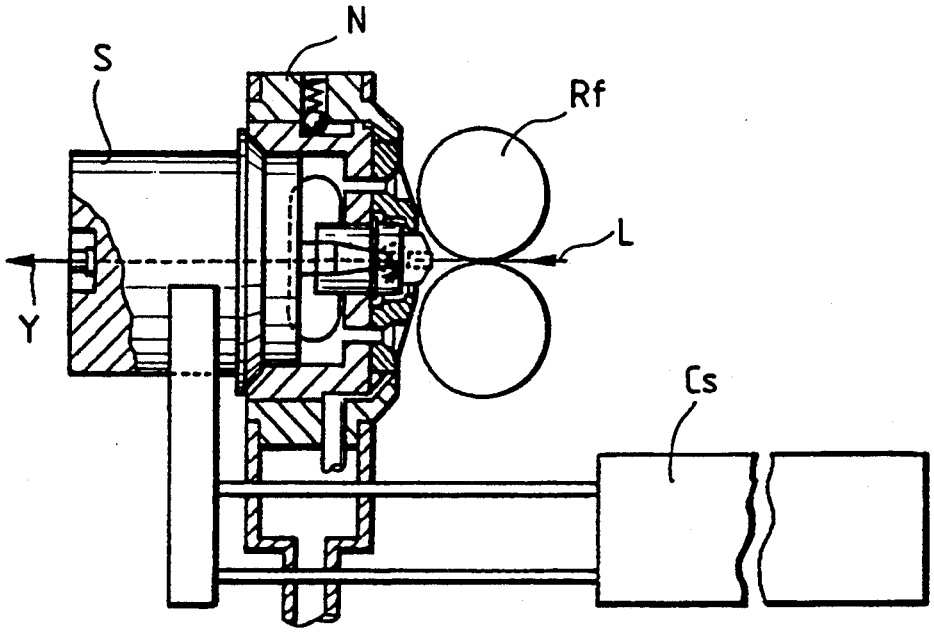

The spindle member S in the state where the opened and ear-like spun yarn Y appears from the end of the hollow spindle s as shown in FIG. 35 is joined to the nozzle member N by the operation of the cylinder Cs, and the driving of the spinning machine restarts (FIG. 36).

The advantageous operation and effects of the aforementioned embodiments of the present invention are listed below.

The piecing in the spinning machine can be automated in which the spinning section is divided into the nozzle member and the spindle member which are made to be moved to and from each other, and by the air sucker member or the transfer arm member, etc., the sliver supplied to the spinning section is spread in the outer periphery of the end of the hollow spindle by the air jetting and the fibers are twisted to form a spun yarn.

The spinning section is divided into the nozzle member and the spindle member which are made to be moved to and from each other, whereby the threading to the hollow spindle is facilitated, and the cleaning of the spinning section such as the nozzle member can be completely and speedily carried out.

The spindle member in the spinning section is separated from the nozzle member, and after this, the nozzle member is separated from the front roller of the draft device making use of jetting of air and air is jetted against the front roller or the nozzle. Therefore, the cleaning of the nozzle including the front roller can be completely and speedily carried out. Furthermore, air is jetted from air jet holes for twisting fibers whereby the nozzle casing and the like can be completely cleaned.

In drawing and upwardly moving the spun yarn wound into the package by the suction pipe, the guide member having the guide plate or the like is provided. Therefore, the handling of the spun yarn such as thereafter delivery of the spun yarn and the control thereof can be positively and speedily carried out.

Since the cutter device for the spun yarn is arranged on the upper guide plate of the guide member, the cut end of the spun yarn gripped by the yarn finger of the transfer arm member can be shortened. Thus, it is possible to prevent the spun yarn from being contacted or entangled with the members of the spinning machine during the transportation.

The yarn finger of the transfer arm member for gripping and delivering the spun yarn is driven and controlled through the accel wire. Therefore, the delivery or movement of the spun yarn can be accurately carried out and the piecing apparatus can be made compact.

The yarn finger is provided in which a pair of feed rollers which are moved to and from each other is driven and controlled by an accel wire. Therefore, the feed amount of the spun yarn inserted into the spindle member can be accurately controlled, and the piecing can be carried out positively and speedily.

Since the yarn finger of the transfer arm member is driven and controlled through the accel wire, the adjustment of the position of the yarn finger is free by the transmission of the accel wire of the accel wire member, and an error in curvature of the arm can be easily absorbed.

The insertion operation of the spun yarn into the spindle member and the opening operation of the spun yarn are separately carried out and are continuously carried out by the movement of the cylinder rod. Therefore, the respective operations can be positively carried out and the piecing work can be done speedily.

Since the fins are provided on the outer wall of the internal nozzle of the air sucker member, it is positively prevent the air flowing into the space formed between the sliding nozzle and the internal nozzle from being a turning air current. Thus, the spun yarn to be opened can be maintained in a natural state, and troubles such that the sucked spun yarn is untwisted and cut.

The suction pipe for inserting the spun yarn into the spindle member is made slidable and can be contacted and fitted with the hollow spindle of the spindle member. Therefore, the insertion of the spun yarn into the hollow spindle can be made positively, and the inertia rotation of the hollow spindle can be stopped speedily and the piecing time can be shortened.

Since the nip roller constituting the spun yarn delivery member is made to be moved to and from the delivery roller, the delivery timing for the spun yarn when spinning restarts can be easily controlled.

Since the nozzle casing is connected to the suction pipe, harmful floating fibers generated within the nozzle casing during spinning can be removed and air jetted out of the air jet holes of the nozzle can be effectively discharged. Thus, it is possible to prevent a generation of an air current harmful for formation of yarn.

The yarn is transferred to the yarn finger for mechanically gripping the spun yarn sucked by the suction mouth. Therefore, as compared to an arrangement wherein the spun yarn is transported upward by the suction mouth, the spun yarn is not disengaged during the transportation, and in addition, the suction of the suction mouth can be weakened, thus saving energy.

The driving source for the back-roller or the like is installed on the piecing apparatus so that when spinning restarts, the back-roller or the like is first driven by the driving source installed on the piecing apparatus. Therefore, it is positively prevent the piecing portion from being uneven due to the difference in the supply amount of the sliver caused by the difference in the operating time of the solenoid clutches.

At least during the maximum difference of operating time of the operating unevenness of the solenoid clutches present between the solenoid clutches, the solenoid clutches are connected and even if the supply of the sliver restarts, the hollow spindle or the like remains in its break-in state, and the sliver supplied during that period is sucked into the suction pipe from the holes formed in the nozzle housing and removed from the spinning section. Therefore, even at the time of restarting spinning, the spinning yarns can be always evenly spun.

Since a portion of the air sucker body into which a hollow spindle is inserted is formed from an air sucker packing formed of an elastic material, even if the stop position of the piecing apparatus is somewhat uneven, such an unevenness can be absorbed by deformation of the air sucker packing. The piecing work of the spun yarn can be more positively carried out.

Since the periphery of the hollow spindle can be held in a closed state dur to the elasticity of the air sucker packing, the suction pressure of the hollow spindle can be increased, and the insertion of the spun yarn into the hollow passage of the hollow spindle can be more positively carried out.

Since the air sucker packing is formed of an elastic material, the inertia rotation of the hollow spindle can be speedily stopped, the time of the piecing work can be further shortened, the shock such as lateral swinging of the hollow spindle can be absorbed, propagation of such a shock to the air sucker body and other portions can be positively prevented, and accordingly, the durability of the piecing apparatus can be enhanced.

Being constructed as described above, the present invention offers the following effect.

The piecing in the spinning machine can be automated in which the spinning section is divided into the nozzle member and the spindle member which are made to be moved to and from each other, and by the air sucker member or the transfer arm member, etc., the sliver supplied to the spinning section is spread in the outer periphery of the end of the hollow spindle by the air jetting and the fibers are twisted to form a spun yarn.

What is claimed is:

1. A piecing method in a spinning apparatus, said spinning apparatus comprising a spindle portion and a nozzle portion having a nozzle for exerting a turning air current on a fiber bundle moved out of a drafting device, the method comprising introducing a yarn end on the package side from the spindle portion into the nozzle to place it in an open state, turning said yarn end around the spindle by jetting a compressed air from said nozzle, and supplying the drafted fiber from the nozzle portion to effect a piecing.

2. A piecing method as claimed in claim 1, wherein said piecing method includes steps comprising drawing a yarn end on the package side in an open state outwardly from a spindle inlet, thereafter exerting a turning air current thereon, supplying a drafted fiber bundle, and starting a winding when a yarn tension increases.

3. A piecing method in a spinning apparatus comprising a spinning unit having a spindle member and a nozzle member for exerting a turning air current on a fiber bundle, the method comprising:

stopping driving of the spinning unit when yarn breakage occurs, separating the spindle member and the nozzle member, drawing a spinning yarn from a package, transferring the spinning yarn to a spinning yarn outlet of the spindle member, passing the spinning yarn through the spindle member, opening an end of the threaded spinning yarn, connecting the spindle member and the nozzle member, and starting driving of the spinning unit.

4. A piecing method in a spinning apparatus comprising a spinning unit having a spindle member and a nozzle member for exerting a turning air current on a fiber bundle, the method comprising:

providing a housing for the nozzle member, providing at least one air blow hole in the housing, providing at least one air jet hole in the nozzle member, separating the spindle member and the nozzle member, moving the nozzle member relative to the housing to thereby expose the at least one air blow hole, blowing air against a nozzle of the nozzle member through the air blow hole to thereby clean the nozzle, and temporarily jetting air from the air jet hole of the nozzle member.

5. A piecing method in a spinning apparatus comprising a spinning unit having a spindle member and a nozzle member for exerting a turning air current on a fiber bundle, the method comprising:

providing a first driving source on a piecing device, providing a second driving source of a spinning unit, supplying a sliver by the first driving source during restart of spinning, allowing a period of time to elapse, and supplying a sliver by the second driving source after elapse of the period of time.

6. A piecing method in a spinning apparatus comprising a spinning unit having a spindle member and a nozzle member for exerting a turning air current on a fiber bundle, the method comprising:

starting a supplying of sliver, driving the spinning unit in a first state after starting the supplying a sliver, sucking the supplied sliver, removing the supplied sliver from a spinning section, allowing a period of time to elapse, and driving the spinning unit in a second state after elapse of the period of time.

7. In a spinning apparatus comprising a spinning unit having a spindle member and a nozzle member for exerting a turning air current on a fiber bundle, a piecing apparatus comprising:

means for sucking a spinning yarn wound on a package, means for reversing the package, means for guiding and cutting the sucked spinning yarn, means for transferring the spinning yarn to a spinning yarn outlet of the spindle member, and movable means on a sliver inlet side of the spindle member for threading and opening of the spinning yarn.

8. The piecing apparatus of claim 7, comprising means for establishing relative movement between the spindle member and the nozzle member.

9. The piecing apparatus of claim 8, comprising:

a housing for the nozzle member, the housing having at least one air blow hole, and means for moving the nozzle member relative to the housing to thereby expose the at least one air blow hole.

10. The piecing apparatus of claim 7, comprising:

a spinning yarn transfer member comprising a pair of rollers, the pair of rollers comprising at least one roller for gripping and feeding out a spinning yarn being rotated and driven, and an accel wire for rotating and driving the roller.

11. The piecing apparatus of claim 7, comprising:

threading means for establishing a suction air current for threading a spinning yarn rewound from a package and transferred to an outlet side of a spindle member of a spinning section into a hollow spindle, and means for opening an end of the threaded spinning yarn by a turning air current.

12. The piecing apparatus of claim 7, comprising threading means for establishing a suction air current for threading a spinning yarn rewound from a package and transferred to an outlet side of a spindle member of a spinning section into a hollow spindle, and means for moving the threading means to thereby establish contact between the threading means and the hollow spindle.

13. The piecing device of claim 12, comprising:

an elastic material forming a portion of the threading means that comes into contact with the hollow spindle.

* * * * *